US007203641B2

(12) United States Patent
Tasaki

(10) Patent No.: US 7,203,641 B2
(45) Date of Patent: Apr. 10, 2007

(54) VOICE ENCODING METHOD AND APPARATUS

(75) Inventor: Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 599 days.

(21) Appl. No.: 10/398,808

(22) PCT Filed: Apr. 16, 2001

(86) PCT No.: PCT/JP01/03240

§ 371 (c)(1),
(2), (4) Date: Apr. 10, 2003

(87) PCT Pub. No.: WO02/35522

PCT Pub. Date: May 2, 2002

(65) Prior Publication Data

US 2004/0111256 A1 Jun. 10, 2004

(30) Foreign Application Priority Data

Oct. 26, 2000 (JP) ..... 2000-327322

(51) Int. Cl.
*G10L 19/06* (2006.01)

(52) U.S. Cl. ..... 704/223

(58) Field of Classification Search ..... 704/219–223
See application file for complete search history.

(56) References Cited

U.S. PATENT DOCUMENTS 6,311,154 B1 * 10/2001 Gersho et al. ..... 704/219
6,330,534 B1 * 12/2001 Yasunaga et al. ..... 704/223
6,393,390 B1 * 5/2002 Patel et al. ..... 704/207
6,393,391 B1 * 5/2002 Ozawa ..... 704/219

(Continued)

FOREIGN PATENT DOCUMENTS

JP 61-51200 A 3/1986
JP 4-35527 A 2/1992
JP 4-298800 A 10/1992
JP 6-236198 A 8/1994
JP 6-266399 A 9/1994

(Continued)

OTHER PUBLICATIONS

ITU-T Recommendation G.729, International Telecommunication Union, "General Aspects of Digital Transmission Systems", pp. 1-35, (1996).

*Primary Examiner*—Abul K. Azad
(74) *Attorney, Agent, or Firm*—Birch, Stewart, Kolasch & Birch, LLP

(57) ABSTRACT

In order to achieve a speech encoding method and device of high quality, which are small in local occurrence of abnormal noise in decoded speech, the speech encoding method and device include: fixed excitation generating means 13 for generating a plurality of fixed excitations; a first distortion calculating portion 23 for calculating a distortion related to a waveform defined between a signal to be encoded which is obtained from the input speech and a synthetic vector which is obtained from the fixed excitation as a first distortion for each of the fixed excitations; a second distortion calculating portion 24 for calculating a second distortion different from the first distortion which is defined between the signal to be encoded and the synthetic vector determined from the fixed excitation for each of the fixed excitations; an evaluation value calculating portion 29 for calculating a given evaluation value for search by using the first distortion and the second distortion for each of the vectors; and searching means 20 for selecting the fixed excitation that minimizes the evaluation value for search and outputting a code which is associated with the selected fixed excitation in advance.

17 Claims, 10 Drawing Sheets

U.S. PATENT DOCUMENTS 6,697,430 B1 * 2/2004 Yasunari et al. ..... 375/240.13
6,823,303 B1 * 11/2004 Su et al. ..... 704/220
6,947,889 B2 * 9/2005 Yasunaga et al. ..... 704/223

FOREIGN PATENT DOCUMENTS

JP 7-271397 A 10/1995
JP 9-214349 A 8/1997
JP 9-6396 A 10/1997
JP 9-281998 A 10/1997
JP 10-20890 A 1/1998
JP 10-20898 A 1/1998

* cited by examiner

VOICE ENCODING METHOD AND APPARATUS

This application is the national phase under 35 U.S.C. § 371 of PCT International Application No. PCT/JP01/03240 which has an International filing date of Apr. 1, 2001, which designated the United States of America.

TECHNICAL FIELD

The present invention relates to a speech encoding method and device which compress a digital speech signal to a small information content, and more particularly to a search of a fixed excitation in the speech encoding method and device.

BACKGROUND ART

Up to now, in various speech encoding methods and devices, an input speech is divided into a spectrum envelope information and a excitation which are encoded by a frame unit, respectively, to produce a speech code.

As the most representative speech encoding method and device, there is a code-excited linear prediction (CELP) system disclosed in Document 1 (ITU-T Recommendation G.729, "CODING OF SPEECH AT 8 kbit/s USING CONJUGATE-STRUCTURE ALGEBRAIC-CODE-EXCITED LINEAR-PREDICTION (CS-ACELP)", March of 1996), or the like.

FIG. 8 is a block diagram showing an overall structure of a conventional CELP system speech encoding device disclosed in Document 1.

Referring to the figure, reference numeral 1 denotes an input speech, reference numeral 2 is a linear prediction analyzing means, reference numeral 3 is a linear prediction coefficient encoding means, reference numeral 4 is an adaptive excitation encoding means, reference numeral 5 is a fixed excitation encoding portion, reference numeral 6 is a gain encoding means, reference numeral 7 is a multiplexing means, and reference numeral 8 is a speech code.

The conventional speech encoding device conducts processing by a frame unit with one frame of 10 ms. In encoding the excitation, processing is conducted every sub-frame that results from dividing one frame into two equal pieces. For facilitation of description, in the description below, the frame and the sub-frame are not particularly distinct and referred to simply as "frame".

Hereinafter, the operation of the conventional speech encoding device will be described. First, the input speech 1 is inputted to the linear prediction analyzing means 2, the adaptive speech encoding means 4 and the gain encoding means 6, respectively. The linear prediction analyzing means 2 analyzes the input speech 1 and extracts a linear prediction coefficient which is a spectrum envelope information of the speech. The linear prediction coefficient encoding means 3 encodes the linear prediction coefficient and outputs a code of the encoded linear prediction coefficient to the multiplexing means 7 and outputs the linear prediction coefficient which has been quantized for encoding the excitation.

The adaptive excitation encoding means 4 stores a past excitation (signal) having a given length as an adaptive excitation codebook therein, and generates a time series vector (adaptive excitation) that periodically repeats the past excitation in correspondence with each adaptive excitation code indicated by a binary value of several bits which is generated internally. Then, the time series vector is allowed to pass through a synthesis filter using the quantized linear prediction coefficient which has been outputted from the linear prediction coefficient encoding means 3, to thereby obtain a temporal synthetic speech. A distortion between a signal resulting from multiplying the temporal synthetic speech by an appropriate gain and the input speech 1 is investigated, and an adaptive excitation code that minimizes the distortion minimizes is selected and then outputted to the multiplexing means 7, and simultaneously the time series vector that corresponds to the selected adaptive excitation code is outputted as the adaptive excitation to the fixed excitation encoding portion 5 and the gain encoding means 6. Also, a signal resulting from subtracting from the input speech 1 the signal obtained by multiplying the synthetic speech by the appropriate gain due to the adaptive excitation is outputted to the fixed excitation encoding portion 5 as a signal to be encoded.

The fixed excitation encoding portion 5 first sequentially reads the time series vector (fixed excitation) from the drive speech codebook that is stored internally in correspondence with the respective fixed excitation codes that are indicated by the binary values which are generated internally. Then, the time series vector is allowed to pass through the synthesis filter using the quantized linear prediction coefficient which has been outputted from the linear prediction coefficient encoding means 3, to thereby obtain a temporal synthetic speech. A distortion between a signal resulting from multiplying the temporal synthetic speech by an appropriate gain and the signal to be encoded which is a signal resulting from subtracting the synthetic speech due to the adaptive excitation from the input speech 1 is investigated, and the fixed excitation code that minimizes the distortion is selected and outputted to the multiplexing means 7, and the time series vector that corresponds to the selected fixed excitation code is outputted to the gain encoding means 6 as the fixed excitation.

The gain encoding means 6 first sequentially reads the gain vector from the gain codebook that is stored therein in accordance with each gain code indicated by the binary value which is generated internally. Then, each of the component of the respective gain vectors are multiplied by the adaptive excitation outputted from the adaptive excitation encoding means 4 and the fixed excitation outputted from the fixed excitation encoding means 5, respectively, and added to each other to produce a excitation, and the produced excitation is allowed to pass through a synthesis filter using a quantized linear prediction coefficient which has been outputted from the linear prediction coefficient encoding means 3, to thereby obtain a temporal synthetic speech. A distortion between the temporal synthetic speech and the input speech 1 is investigated, and a gain code that minimizes the distortion is selected and then outputted to the multiplexing means 7. Also, the excitation thus produced which corresponds to the gain code is outputted to the adaptive excitation encoding means 4.

Finally, the adaptive excitation encoding means 4 updates the internal adaptive excitation codebook by using the excitation corresponding to the gain code which is produced by the gain encoding means 6.

The multiplexing means 7 multiplexes the code of the linear prediction coefficient outputted from the linear prediction coefficient encoding means 3, the adaptive excitation code outputted from the adaptive excitation encoding means 4, the fixed excitation code outputted from the fixed excitation encoding portion 5 and the gain code outputted from the gain encoding means 6 to output the obtained speech code 8.

FIG. 9 is a block diagram showing the detailed structure of the fixed excitation encoding portion 5 of the conventional CELP system speech encoding device disclosed in Document 1 or the like.

Referring to FIG. 9, reference numeral 9 denotes an adaptive excitation generating means, reference numeral 10 and 14 are synthesis filters, reference numeral 11 is a subtracting means, reference numeral 12 is a signal to be encoded, reference numeral 13 is a fixed excitation generating means, reference numeral 15 is a distortion calculating portion, reference numeral 20 is a searching means, reference numeral 21 is a fixed excitation code, and reference numeral 22 is a fixed excitation. The distortion calculating portion 15 is made up of an perceptual weighting filter 16, an perceptual weighting filter 17, a subtracting means 18 and a power calculating means 19. The adaptive excitation generating means 9, the synthesis filter 10 and the subtracting means 11 are included in the adaptive excitation encoding means 4, but are shown together for facilitation of understanding the contents.

First, the adaptive excitation generating means 9 within the adaptive excitation encoding means 4 outputs a time series vector corresponding to the above-mentioned adaptive excitation code to the synthesis filter 10 as the adaptive excitation.

The synthesis filter 10 within the adaptive excitation encoding means 4 sets the quantized linear prediction coefficient outputted from the linear prediction coefficient encoding means shown in FIG. 8 as a filter coefficient, and conducts synthesis filtering on the adaptive excitation outputted from the adaptive excitation generating means 9 to output the obtained synthetic speech to the subtracting means 11.

The subtracting means 11 within the adaptive excitation encoding means 4 determines a difference signal between the synthetic speech outputted from the synthesis filter 10 and the input speech 1 and outputs the obtained difference signal as the signal 12 to be encoded in the fixed excitation encoding portion 5.

On the other hand, the searching means 20 sequentially generates the respective fixed excitation codes indicated by the binary values, and outputs the fixed excitation codes to the fixed excitation generating means 13 in order.

The fixed excitation generating means 13 reads the time series vector from the fixed excitation codebook stored internally in accordance with the fixed excitation code outputted from the searching means 20, and outputs the time series vector to the synthesis filter 14 as the fixed excitation. The fixed excitation codebook may be a fixed excitation codebook that stores a noise vector prepared in advance, an algebraic excitation codebook that algebraically describes the time series vector by combination of a pulse position with a polarity, or the like. Also, there are fixed excitation codebooks which are of the addition type of two or more codebooks or which include a pitch cycling using the repetitive cycle of the adaptive excitation therein.

The synthesis filter 14 sets the quantized linear prediction coefficient that are outputted from the linear prediction coefficient encoding means 3 as the filter coefficient, and conducts the synthesis filtering on the fixed excitation outputted from the fixed excitation generating means 13 to output the obtained synthetic speech to the distortion calculating portion 15.

The perceptual weighting filter 16 within the distortion calculating portion 15 calculates an perceptual weighting filter coefficient on the basis of the quantized linear prediction coefficient that are outputted from the linear prediction coefficient encoding means 3, sets the perceptual weighting filter coefficient as the filter coefficient, and filters the signal 12 to be encoded which is outputted from the subtracting means 11 within the adaptive excitation encoding means 4 to output the obtained signal to the subtracting means 18.

The perceptual weighting filter 17 within the distortion calculating portion 15 sets the same filter coefficient as the perceptual weighting filter 16, and filters the synthetic speech outputted from the synthesis filter 14 to output the obtained signal to the subtracting means 18.

The subtracting means 18 within the distortion calculating portion 15 determines a difference signal between the signal outputted from the perceptual weighting filter 16 and a signal resulting from multiplying the signal outputted from the perceptual weighting filter 17 by an appropriate gain, and outputs the difference signal to the power calculating means 19.

The power calculating means 19 within the distortion calculating portion 15 obtains a total power of the difference signal outputted from the subtracting means 18, and outputs the total power to the searching means 20 as a evaluation value for search.

The searching means 20 searches a fixed excitation code that minimizes the evaluation value for search outputted from the power calculating means 19 within the distortion calculating portion 15, and outputs the fixed excitation code that minimizes the evaluation value for search as the fixed excitation code 21. Also, the fixed excitation generating means 13 outputs the fixed excitation outputted when inputting the fixed excitation code 21 as the fixed excitation 22.

The gain multiplied by the subtracting means 18 is uniquely determined by solving a partial differential equation so as to minimize the evaluation value for search. Various modified manners of the internal structure of the actual distortion calculating portion 15 have been reported in order to reduce the amount of calculation.

Also, JP 7-271397 A discloses several methods of reducing the amount of calculation of the distortion calculating portion. Hereinafter, the method of the distortion calculating portion disclosed in JP 7-271397 A will be described.

Assuming that a synthetic speech obtained by allowing the fixed excitation to pass through the synthesis filter 14 is Yi and an input speech is R (corresponding to the signal 12 to be encoded in FIG. 9), the evaluation value for search defined as a waveform-related distortion between two signals is represented by Expression (1).

$$E=|R-\alpha Y_i|^2 \tag{1}$$

This coincides with a case in which the perceptual weighting filter is not introduced in the evaluation value for search calculation described with reference to FIG. 9. $\alpha$ is a gain multiplied by the subtracting means 18, and a that sets an expression resulting from partially differentiating Expression (1) with respect to a to zero is found, and this is substituted for a in Expression (1) to obtain Expression (2).

$$E = |R|^2 - (R, Y_i)^2 / |Y_i|^2 \tag{2}$$

Since a first term of Expression (2) is a constant that does not depend on the fixed excitation, minimizing the evaluation value for search E is equal to maximizing a second term of Expression (2). Therefore, there are many cases in which the second term of Expression (2) is used as the evaluation value for search as it is.

Because a large amount of calculation is required for calculating the second term of Expression (2), a preliminary selection is conducted using the simplified evaluation value for search, and the second term of Expression (2) is calculated with respect to only the fixed excitation that is preliminarily selected, and a main selection is then conducted to reduce the amount of calculation in JP 7-271397 A.

Expressions (3) to (5) or the like are employed as the simplified evaluation value for search used in the preliminary selection.

$$E'=(R,Y_i)^2 \tag{3}$$

$$E'=W(y_i)(R,Y_i)^2 \tag{4}$$

$$E'=W(C,i)(R,Y_i)^2 \tag{5}$$

There has been reported that Yi is a fixed excitation, C is a fixed excitation group stored in the codebook, and the weight coefficient W defined by those factors is set as the evaluation value for search in the preliminary selection with the result that a precision in the preliminary selection in the case of using Expression (4) or Expression (5) is higher than that in the case of using Expression (3).

Comparing Expression (3), Expression (4) and Expression (5) which are the simplified evaluation value for search s at the time of the preliminary selection with the second term of Expression (2) which is the evaluation value for search at the time of the main selection, there are only differences in the multiplication of the weight coefficient based on the fixed excitation group C or the fixed excitation yi, and the subtraction portion due to the power of the synthetic speech Yi of the fixed excitation. Expression (3), Expression (4) and Expression (5) approximate the second term of Expression (2), and both cases evaluate the waveform-related distortion between two signals indicated in Expression (1).

However, the above-mentioned conventional speech encoding method and method suffer from problems stated below.

In the case where the information content which is applicable to the fixed excitation code is small, that is, when the number of fixed excitations becomes smaller, even if the fixed excitation code that minimizes the waveform distortion described with reference to Expression (1) to Expression (5) is selected, a decoded speech obtained by decoding the speech code including the fixed excitation code therein may be deteriorated in tone quality.

FIG. 10 is an explanatory diagram for explaining one case in which the tone quality is deteriorated. In FIG. 10, reference symbol (a) is a signal to be encoded, reference symbol (c) is a fixed excitation, and reference symbol (b) is a synthetic speech obtained by allowing the fixed excitation shown in (c) to pass through the synthesis filter. All of those signals are indicative of signals within a frame to be encoded. In this example, an algebraic excitation that algebraically expresses the pulse position and the polarity is used as the fixed excitation.

In case of FIG. 10, the similarity between (a) and (b) is high in the second half of the frame, and (a) is relatively excellently expressed. On the other hand, the amplitude of (b) becomes 0 in the first half of the frame, and (a) cannot be expressed at all. In the case where the gain of the adaptive excitation is not largely taken on the rising portion of the speech or the like, there are many cases in which a portion at which the encoding characteristic of the partial frame is extremely deteriorated sounds like a local abnormal noise on the decoded speech.

That is, in the conventional method of selecting the fixed excitation code that minimizes the waveform-related distortion of the overall frame, even if the portion at which the encoding characteristic is extremely deteriorated exists on a part of the frame as shown in FIG. 10, the fixed excitation code is selected, resulting in a problem that the quality of the decoded speech is deteriorated.

This problem is not eliminated even by using the simplified evaluation value for search as disclosed in JP 7-271397 A.

The present invention has been made to solve the above-mentioned problem, and therefore an object of the present invention is to provide a high-quality speech encoding method and device which hardly generate a local abnormal noise of the decoded speech. Also, another object of the present invention is to provide a high-quality speech encoding method and device while suppressing an increase in the amount of calculation to the minimum.

DISCLOSURE OF THE INVENTION

In order to attain the above-mentioned object, in a speech encoding method for encoding an input speech for each of given length sections which are called frames, a speech encoding method according to the present invention includes: a fixed excitation generating step of generating a plurality of fixed excitations; a first distortion calculating step of calculating a distortion related to a waveform defined between a signal to be encoded which is obtained from the input speech and a synthetic vector which is obtained from the fixed excitation as a first distortion for each of the fixed excitations; a second distortion calculating step of calculating a second distortion different from the first distortion which is defined between the signal to be encoded and the synthetic vector which is obtained from the fixed excitation for each of the fixed excitations; an evaluation value calculating step of calculating a given evaluation value for search by using the first distortion and the second distortion for each of the fixed excitations; and a searching step of selecting the fixed excitation that minimizes the evaluation value for search and outputting a code which is associated with the selected fixed excitation in advance.

Further, the speech encoding method includes a preliminary selecting step of selecting two or more fixed excitations which are small in the first distortion calculated by the first distortion calculating step, and is characterized in that subjects of the second distortion calculating step, the evaluation calculating step, and the searching step are limited to the fixed excitation selected by the preliminary selecting step.

Further, the speech encoding method includes: a plurality of fixed excitation generating steps of generating the fixed excitations different from each other; and a preliminary selecting step of selecting one or more fixed excitations which is small in the first distortion calculated by the first distortion calculating step for each of the fixed excitation generating steps, and is characterized in that subjects of the second distortion calculating step, the evaluation calculating step, and the searching step are limited to the fixed excitation selected by the preliminary selecting step.

Further, the speech encoding method is characterized in that the first distortion calculating step sets as the first distortion a result of adding an error power of a signal resulting from allowing the signal to be encoded which is obtained from the input speech to pass through the perceptual weighting filtering and a signal resulting from allowing the synthetic vector obtained from the fixed excitation to pass through the perceptual weighting filter for each of samples within the frame.

Further, the speech encoding method is characterized in that the second distortion calculating step sets the distortion related to the deviation of an amplitude or a power in a time direction within the frame as a second distortion.

Further, the speech encoding method is characterized in that the second distortion calculating step obtains a center-of-gravity position of the amplitude or the power of the signal to be encoded within the frame, obtains the center-of-gravity position of the amplitude or the power of the synthetic vector within the frame, and sets a difference of the obtained two center-of-gravity positions as the second distortion.

Further, the speech encoding method is characterized in that the evaluation value calculating step calculates the evaluation value for search by correcting the first distortion in accordance with the second distortion.

Further, the speech encoding method is characterized in that the evaluation value calculating step calculates the evaluation value for search by a weighting sum of the first distortion and the second distortion.

Further, the speech encoding method is characterized in that the evaluation value calculating step changes a process of calculating the evaluation value for search in accordance with a given parameter calculated from the input speech.

Further, the speech encoding method includes a contribution degree calculating step of setting as another excitation contribution degree a ratio of an energy of the synthetic vector obtained from the excitation vector other than the fixed excitation and an energy of the input speech, and is characterized in that the calculated another excitation contribution degree is set as the given parameter in the evaluation value calculating step.

Further, the speech encoding is characterized in that the evaluation value calculating step changes a process of calculating the evaluation value for search in accordance with from which fixed excitation generating step the fixed excitation is outputted.

Further, the speech encoding method is characterized in that the evaluation value calculating step includes a process of setting the first distortion as the evaluation value for search as it is as one of processes of calculating the evaluation value for search.

In a speech encoding device for encoding an input speech for each of given length sections which are called frames, a speech encoding device according to the present invention is characterized by including: a fixed excitation generating means for generating a plurality of fixed excitations; a first distortion calculating means for calculating a distortion related to a waveform defined between a signal to be encoded which is obtained from the input speech and a synthetic vector which is obtained from the fixed excitation as a first distortion for each of the fixed excitations; a second distortion calculating means for calculating a second distortion different from the first distortion which is defined between the signal to be encoded and the synthetic vector which is obtained from the fixed excitation for each of the fixed excitations; an evaluation value calculating means for calculating a given evaluation value for search by using the first distortion and the second distortion for each of the fixed excitations; and a searching means for selecting the fixed excitation that minimizes the evaluation value for search and outputting a code which is associated with the selected fixed excitation in advance.

Further, the speech encoding device is characterized in that the first distortion calculating means sets as the first distortion a result of adding an error power of a signal resulting from allowing the signal to be encoded which is obtained from the input speech to pass through the perceptual weighting filtering and a signal resulting from allowing the synthetic vector obtained from the fixed excitation to pass through the perceptual weighting filter for each of samples within the frame.

Further, the speech encoding device is characterized in that the second distortion calculating means sets the distortion related to the deviation of an amplitude or a power in a time direction within the frame as a second distortion.

Further, the speech encoding device is characterized in that the evaluation value calculating means calculates the evaluation value for search by correcting the first distortion in accordance with the second distortion.

Further, the speech encoding device is characterized in that the evaluation value calculating means changes a process of calculating the evaluation value for search in accordance with a given parameter calculated from the input speech.

BRIEF DESCRIPTION OF THE DRAWINGS

FIG. 9 is a block diagram showing the detailed structure of a fixed excitation encoding portion 5 of the CELP system speech encoding device disclosed in the above-mentioned Document 1 or the like.

BEST MODES FOR CARRYING OUT THE INVENTION

Hereinafter, the respective embodiments of the present invention will be described with reference to the accompanying drawings.

First Embodiment

Figure 1:
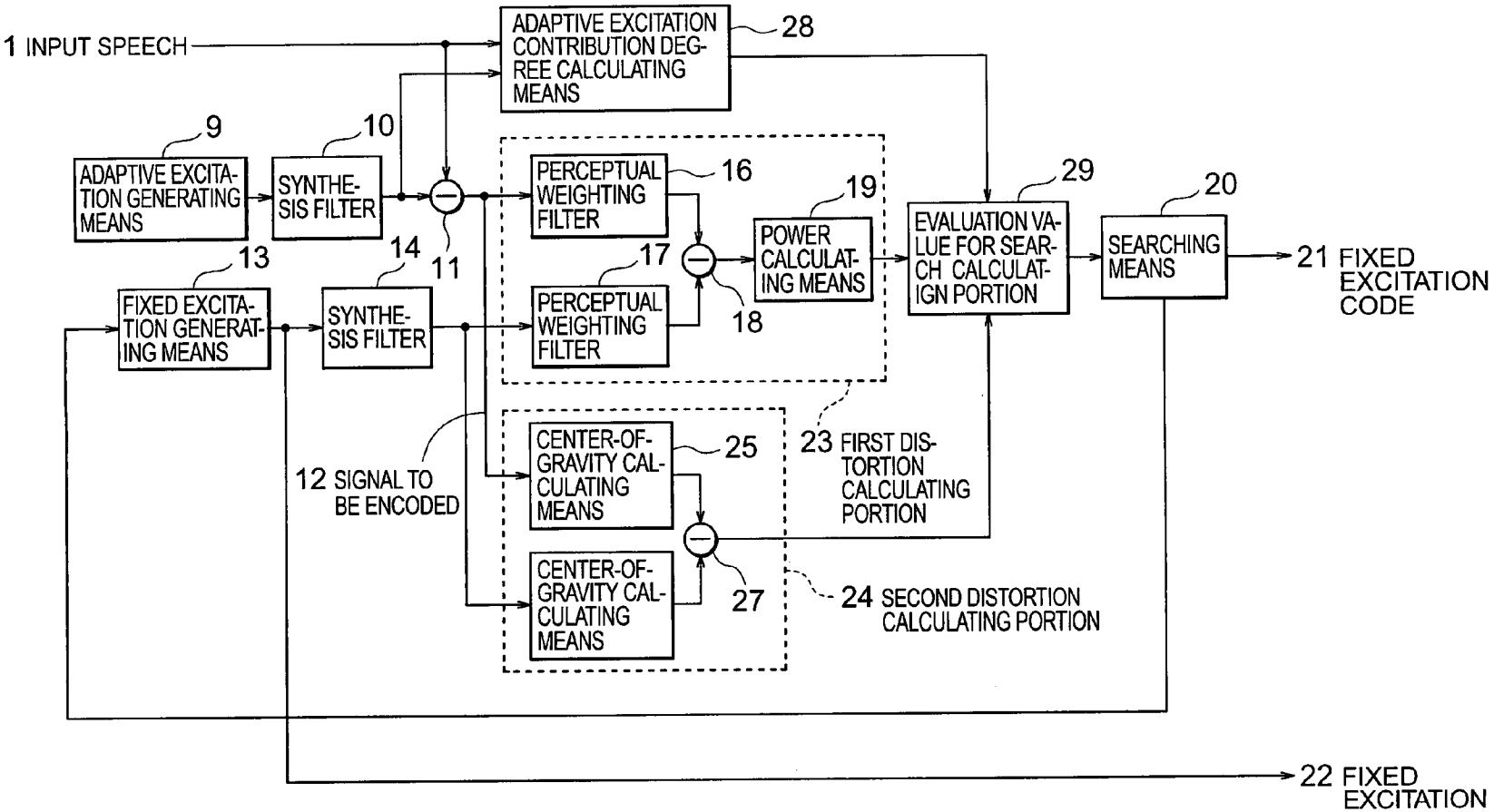
FIG. 1 is a block diagram showing a detailed structure of a fixed excitation encoding portion 5 in a speech encoding device to which a speech encoding method of the present invention is applied in accordance with a first embodiment.

FIG. 1 is a block diagram showing the detailed structure of a fixed excitation encoding portion 5 in a speech encoding device to which a speech encoding method of the present invention is applied in accordance with a first embodiment.

Figure 8:
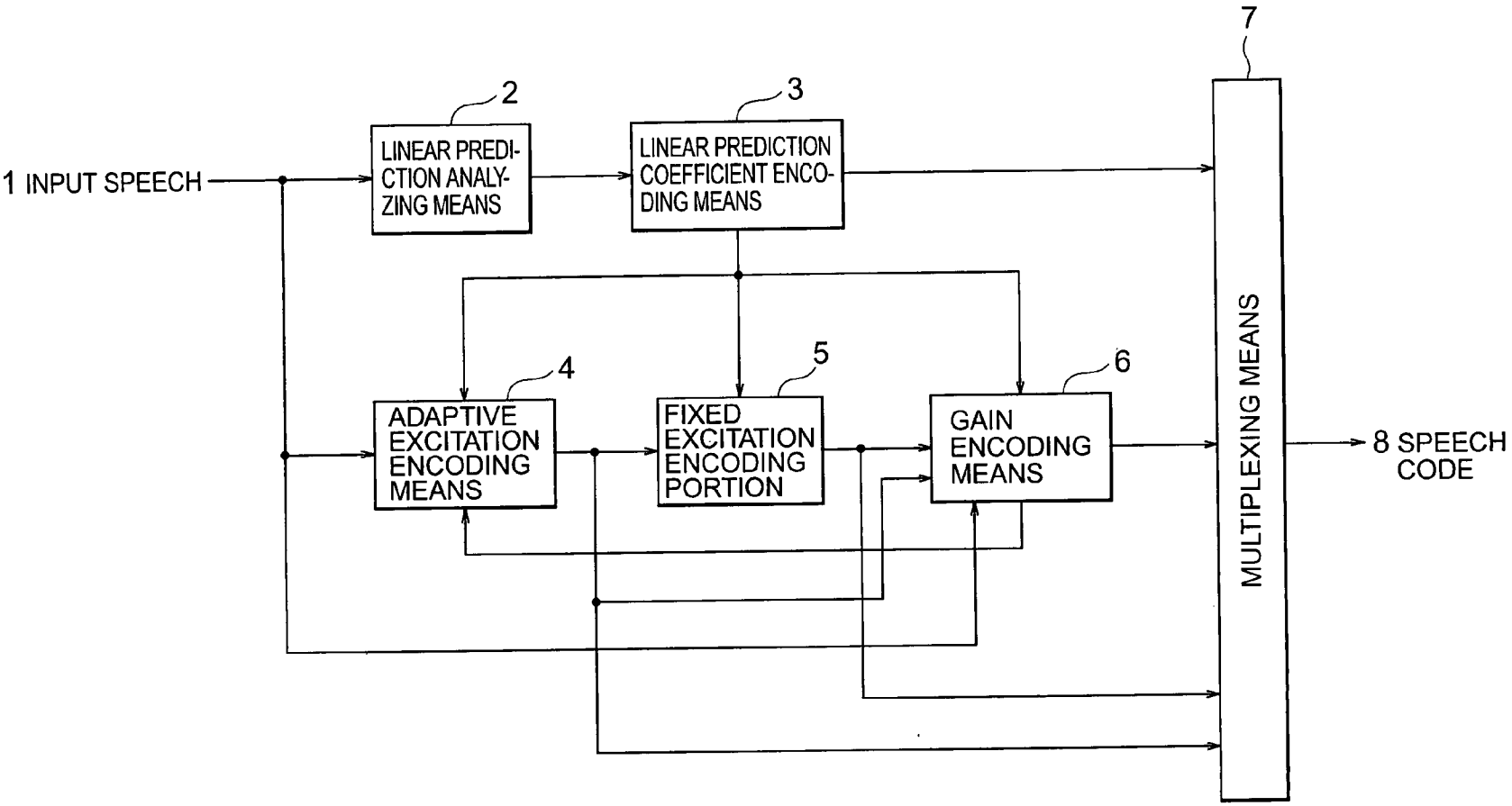
FIG. 8 is a block diagram showing the overall structure of a CELP system speech encoding device disclosed in Document (ITU-T Recommendation G.729, "CODING OF SPEECH AT 8 kbit/s USING CONJUGATE-STRUCTURE ALGEBRAIC-CODE-EXCITED LINEAR-PREDICTION (CS-ACELP)", March of 1996)

The overall structure of the speech encoding device in accordance with the first embodiment is identical with the structure shown in FIG. 8, but an input of an input speech 1 is added to the fixed excitation encoding portion 5.

Figure 9:
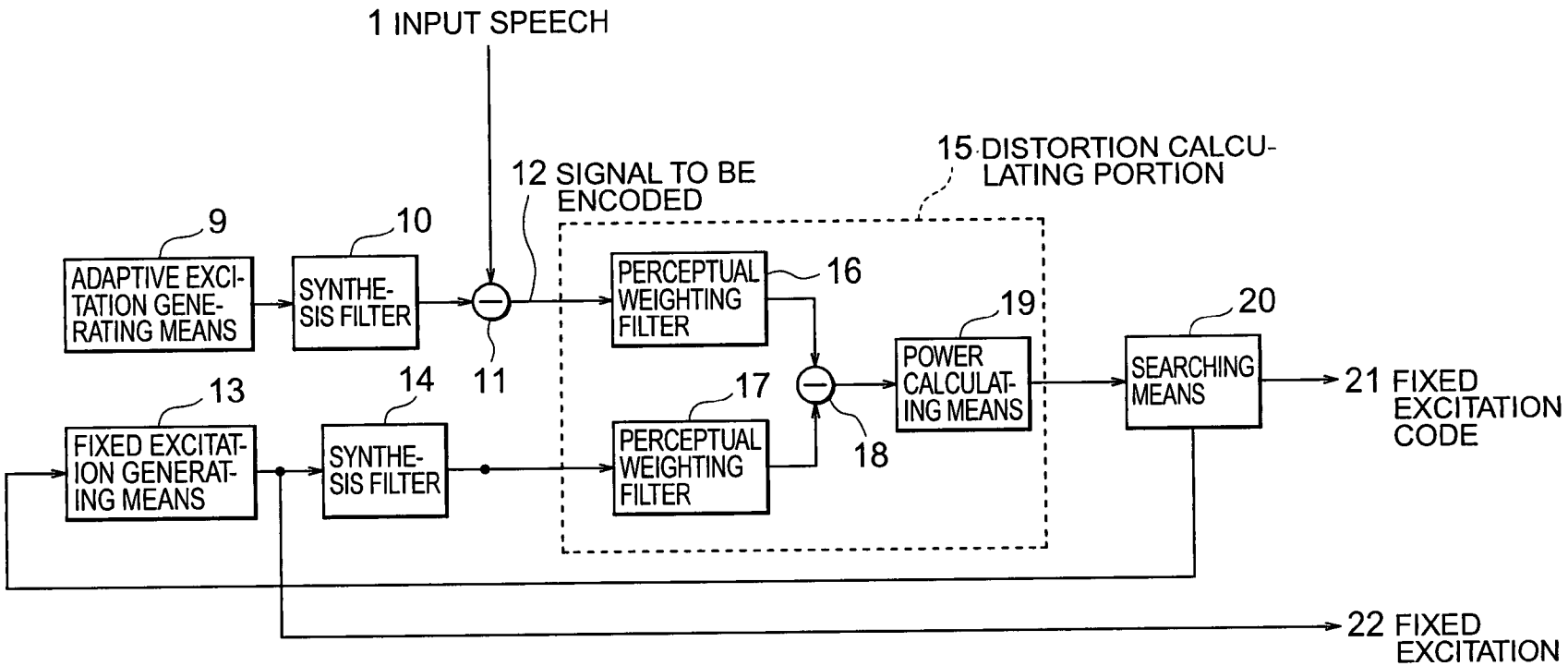

Referring to FIG. 1, the same parts as the structure of the fixed excitation encoding portion 5 in the conventional example shown in FIG. 9 are designated by the same reference numerals, and their descriptions will be omitted. As new reference numerals, reference numeral 23 denotes a first distortion calculating portion that is made up of the perceptual weighting filters 16 and 17, the subtracting means 18, and the power calculating means 19; reference numeral 24 is a second distortion calculating portion that is made up of the center-of-gravity calculating means 25 and 26, and the subtracting means 27; reference numeral 28 is an adaptive excitation contribution degree calculating means; and reference numeral 29 is a evaluation value for search calculating portion. Note that the adaptive excitation generating means 9, the synthesis filter 10, and the subtracting means 11 are installed within the adaptive excitation encoding means 4 shown in FIG. 8, but are shown together for facilitation of understanding the contents.

Hereinafter, a description will be given of the operation of the fixed excitation encoding portion 5 in accordance with the first embodiment.

First, the adaptive excitation generating means 9 within the adaptive excitation encoding means 4 outputs a time series vector corresponding to the above-mentioned adaptive excitation code to the synthesis filter 10 as an adaptive excitation.

The synthesis filter 10 within the adaptive excitation encoding means 4 sets a quantized linear prediction coefficient that is outputted from the linear prediction coefficient encoding means 3 as a filter coefficient, and conducts synthesis filtering on the adaptive excitation outputted from the adaptive excitation generating means 9 to output the obtained synthetic speech to the subtracting means 11 and the adaptive excitation contribution degree calculating means 28.

The subtracting means 11 within the adaptive excitation encoding means 4 obtains a difference signal between the synthetic speech outputted from the synthesis filter 10 and the input speech 1, and outputs the obtained difference signal to the first distortion calculating portion 23 and the second distortion calculating portion 24 as the signal 12 to be encoded in the fixed excitation encoding portion 5.

The adaptive excitation contribution degree calculating means 28 calculates the degree of contribution of the adaptive excitation in the encoding of the input speech 1 by using the synthetic speech outputted from the synthesis filter 10, and outputs the obtained adaptive excitation contribution degree to the evaluation value for search calculating portion 29. The specific calculation of the adaptive excitation contribution degree is conducted as follows:

First, when the synthetic speech outputted from the synthesis filter 10 is multiplied by the appropriate gain, the gain is set so as to minimize the waveform distortion of the input speech 1, and the power Pa of the signal resulting from multiplying the synthetic speech outputted from the synthetic film 10 by the gain is obtained. The power P of the input speech 1 is obtained, and the ratio of Pa to P, that is, Pa/P is calculated as the adaptive excitation contribution degree. Note that the appropriate gain can be determined in accordance with the partial differential equation, and the waveform distortion can be directly obtained in the form where the gain is removed from the calculation expression as in Expression (2). Assuming that the input speech 1 is R, and the synthetic speech outputted from the synthesis filter 10 is X, the adaptive excitation contribution degree G can be calculated from Expression (6).

$$G = (R, X)^2 / |R|^2 |X|^2 \tag{6}$$

On the other hand, the searching means 20 sequentially generates the respective fixed excitation codes indicated by binary values, and outputs those fixed excitation codes to the fixed excitation generating means 13 in order.

The fixed excitation generating means 13 reads the time series vector from the fixed excitation codebook stored internally in accordance with the fixed excitation code which is outputted from the searching means 20, and outputs the time series vector to the synthesis filter 14 as the fixed excitation. Note that the fixed excitation codebook may be a fixed excitation codebook that stores a noise vector prepared in advance, an algebraic excitation codebook that algebraically describes the time series vector by combination of a pulse position with a polarity, or the like. Also, there are fixed excitation codebooks which are of the addition type of two or more codebooks or which include a pitch cycling using the repetitive cycle of the adaptive excitation therein.

The synthesis filter 14 sets the quantized linear prediction coefficient that is outputted from the linear prediction coefficient encoding means 3 as the filter coefficient, and conducts the synthesis filtering on the fixed excitation outputted from the fixed excitation generating means 13 to output the obtained synthetic speech to the first distortion calculating portion 23 and the second distortion calculating portion 24.

The perceptual weighting filter 16 within the first distortion calculating portion 23 calculates the perceptual weighting filter coefficient on the basis of the quantized linear prediction coefficient that is outputted from the linear prediction coefficient encoding means 3, sets the perceptual weighting filter coefficient as the filter coefficient, and filters the signal 12 to be encoded which is outputted from the subtracting means 11 within the adaptive excitation encoding means 4, to output the obtained signal to the subtracting means 18.

The perceptual weighting filter 17 within the first distortion calculating portion 23 sets the same filter coefficient as the perceptual weighting filter 16, and filters the synthetic speech outputted from the synthesis filter 14, to output the obtained signal to the subtracting means 18.

The subtracting means 18 within the first distortion calculating portion 23 obtains a difference signal between the signal outputted from the perceptual weighting filter 16 and a signal resulting from multiplying the signal outputted from the perceptual weighting filter 17 by an appropriate gain, and outputs the difference signal to the power calculating means 19.

The power calculating means 19 within the first distortion calculating portion 23 obtains a total power of the difference signal outputted from the subtracting means 18, and outputs the total power to the searching evaluation value calculating portion 29 as a first distortion. The gain multiplied by the subtracting means 18 is uniquely determined by solving a partial differential equation so as to minimize the evaluation value for search. The internal structure of the actual distortion calculating portion 23 can employ the conventional modifying method in order to reduce the amount of calculation.

The center-of-gravity calculating means 25 within the second distortion calculating portion 24 obtains the position of the center of gravity of the amplitude within the frame of the signal 12 to be encoded which is outputted from the subtracting means 11, and outputs the obtained center-of-gravity position to the subtracting means 27. The position of the center of gravity of the amplitude can be obtained as a position that reaches the half of the total value within the frame by calculating the total value of the amplitudes of the objective signal (absolute value of a sample value) and again calculating the total value of the amplitudes from a leading position.

The center-of-gravity calculating means 26 within the second distortion calculating portion 24 obtains the center-of-gravity position of the amplitude of the synthetic speech outputted from the synthesis filter 14 within the frame, and outputs the obtained center-of-gravity position to the subtracting means 27. The calculation of the center-of-gravity position is conducted as with the center-of-gravity calculating means 25.

The subtracting means 27 within the second distortion calculating portion 24 obtains a difference between the center-of-gravity position outputted from the center-of-gravity calculating means 25 and the center-of-gravity position outputted from the center-of-gravity calculating means 26, and outputs the obtained difference of the center-of-gravity positions to the evaluation value for search calculating portion 29 as the second distortion.

The evaluation value for search calculating portion 29 obtains the evaluation value for search used for the final search by using the adaptive excitation contribution degree outputted from the adaptive excitation contribution degree calculating means 28, the first distortion outputted from the first distortion calculating portion 23, and the second distortion outputted from the second distortion calculating portion 24, and outputs the evaluation value for search to the searching means 20.

The searching means 20 searches the fixed excitation code that minimizes the evaluation value for search outputted from the evaluation value for search calculating portion 29, and outputs the fixed excitation code that minimizes the evaluation value for search as the fixed excitation code 21. Also, the fixed excitation generating means 13 outputs the fixed excitation outputted when the fixed excitation code 21 is inputted thereto as the fixed excitation 22.

Figure 2:
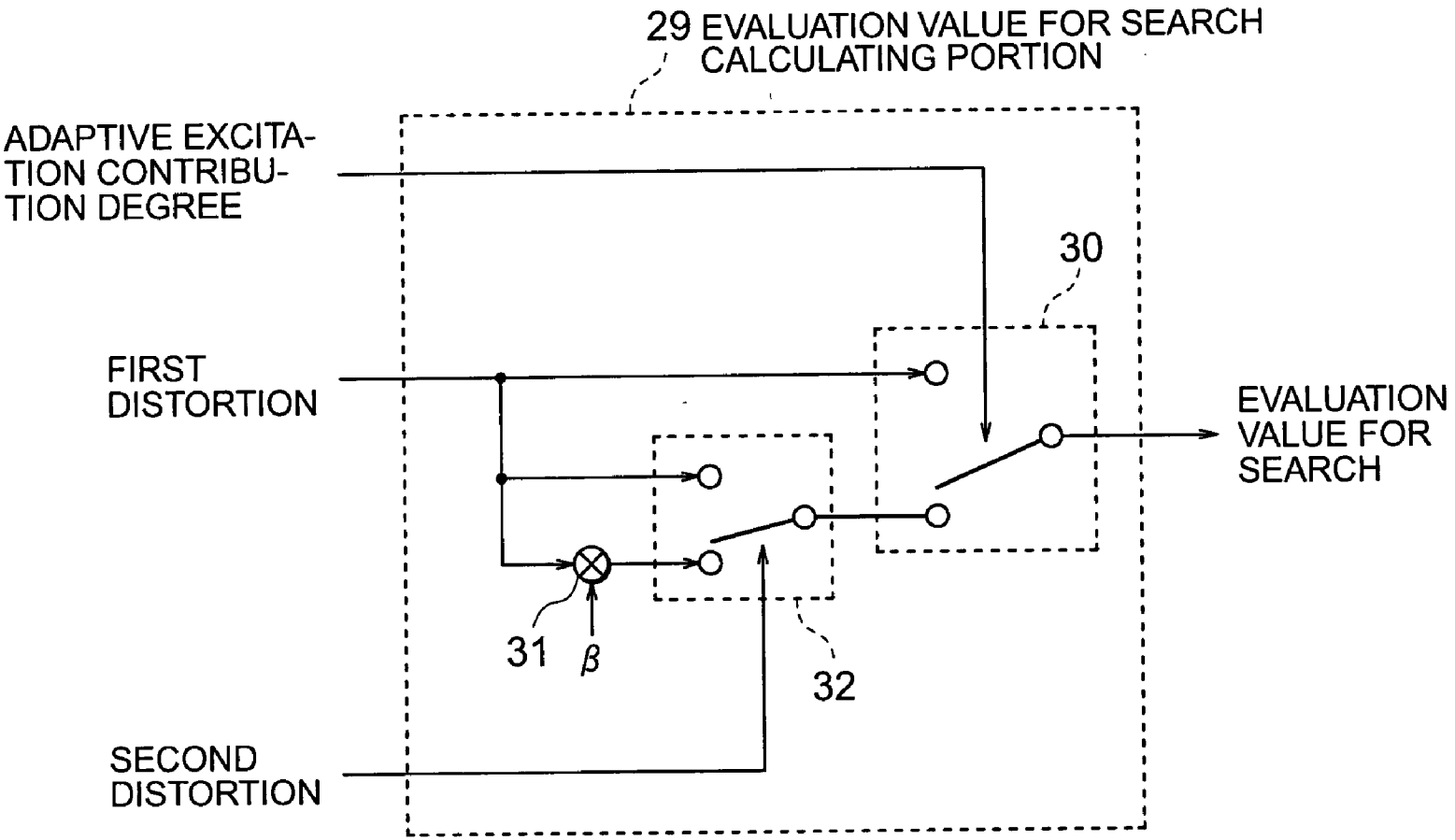
FIG. 2 is a structural diagram showing the structure of a evaluation value for search calculating portion 29 in accordance with the first embodiment of the present invention.

FIG. 2 is a structural diagram showing the structure of the above-mentioned evaluation value for search calculating portion 29.

In FIG. 2, reference numerals 30 and 32 denote changeover means, and reference numeral 31 is a multiplying means.

The multiplying means 31 multiplies the first distortion outputted from the first distortion calculating portion 23 by a constant β prepared in advance, to output the multiplied result. The constant β is appropriately set to about 1.2 to 2.0.

The changeover means 32 connects a changeover switch to the multiplied result outputted from the multiplying means 31 in the case where the second distortion outputted from the second distortion calculating portion 24 exceeds a given threshold value, and connects the changeover switch to the first distortion outputted from the first distortion calculating portion 23 in the case where the second distortion outputted from the second distortion calculating portion 24 is equal to or less than the given threshold value. The given threshold value is appropriately set to about 1/10 of the frame length. As a result, the changeover means 32 outputs the result obtained by multiplying the first distortion by β when the second distortion is larger, and the first distortion as it is when the second distortion is smaller.

The changeover means 30 connects the changeover switch to the first distortion outputted from the first distortion calculating portion 23 in the case where the adaptive excitation contribution degree outputted from the adaptive excitation contribution degree calculating means 28 exceeds a given threshold value, and connects the changeover switch to the output result of the changeover means 32 in the case where the adaptive excitation contribution degree outputted from the adaptive excitation contribution degree calculating means 28 is equal to or less than the given threshold value. The given threshold value is preferably set to about 0.3 to 0.4. Then, the output of the changeover means 30 is outputted from the evaluation value for search calculating portion 29 as the evaluation value for search.

With the above-mentioned structure, the first distortion is normally outputted as the evaluation value for search, and the value obtained by multiplying the first distortion by the constant β is outputted as the evaluation value for search only when the second distortion is larger and the adaptive excitation contribution degree is smaller. That is, only in the case where the second distortion is larger and the adaptive excitation contribution degree is smaller, the evaluation value for search is corrected to a larger value, and the selection of the corresponding fixed excitation code is suppressed in the downstream searching means 20.

Figure 3:
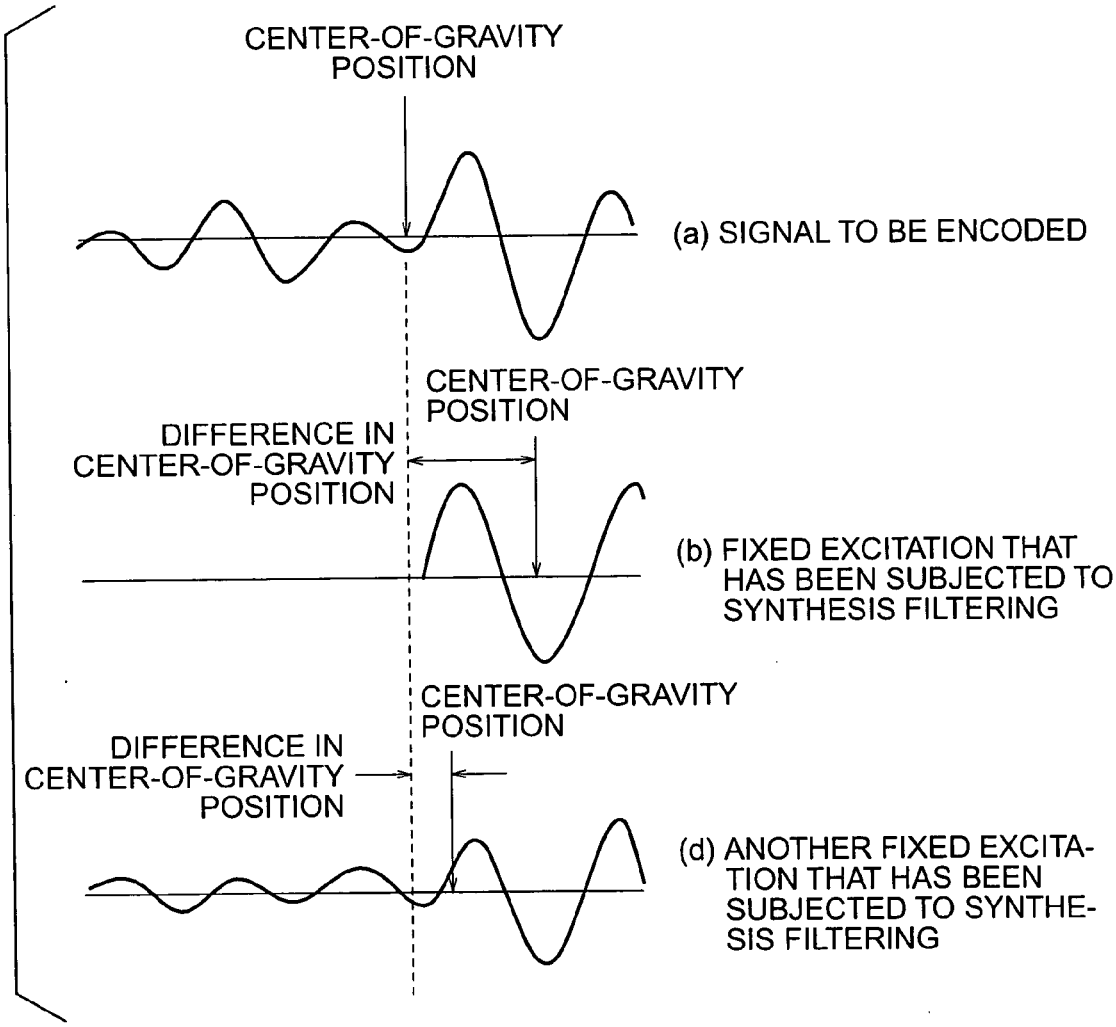
FIG. 3 is an explanatory diagram for explaining the operation of a second distortion calculating portion 24 in accordance with the first embodiment of the present invention.
Figure 10:
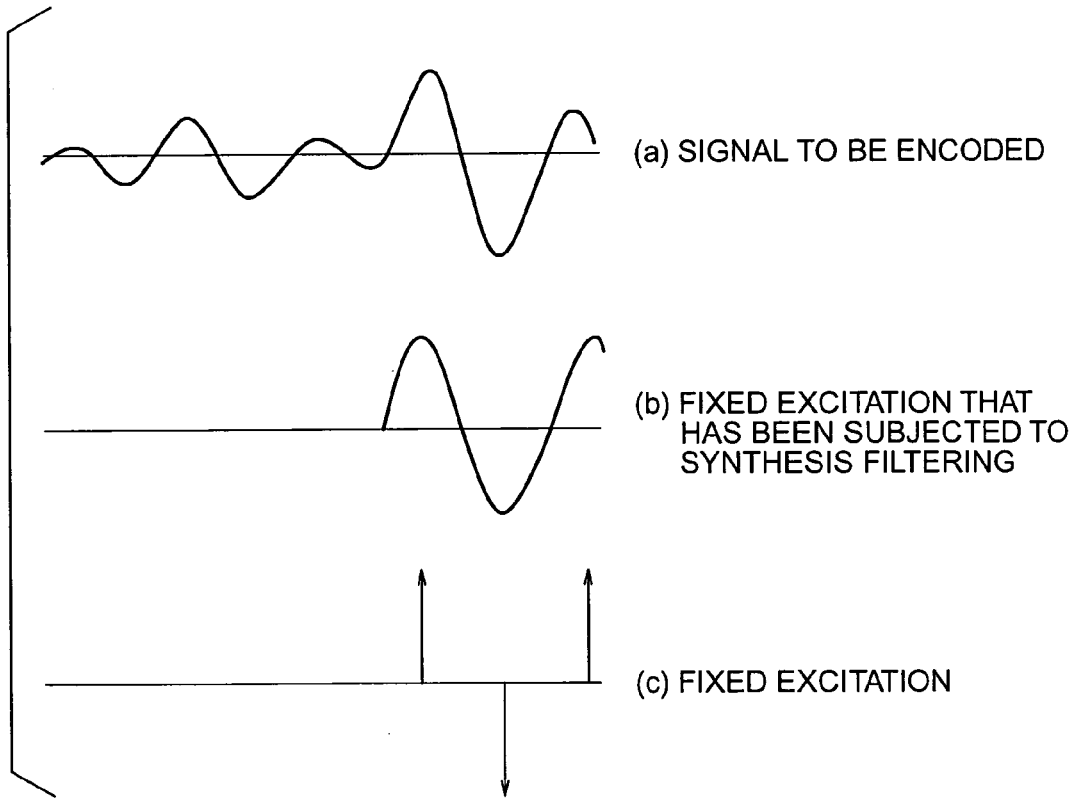
FIG. 10 is an explanatory diagram showing one case that induces the deterioration of a tone quality.

FIG. 3 is an explanatory diagram for explaining the operation of the second distortion calculating portion 24. Note that the signal to be encoded is identical with that in FIG. 10.

The center-of-gravity calculating means 25 obtains the center-of-gravity position of the signal to be encoded as shown in FIG. 3(*a*). The center-of-gravity calculating means 26 obtains the center-of-gravity position of the fixed excitation after synthetically filtering as shown in FIG. 3(*b*). Then, the subtracting means 27 calculates a difference between those two center-of-gravity positions as shown in FIG. 3(*b*).

As shown in FIG. 3, in the case where the amplitude of the fixed excitation after synthetically filtering extremely deviates within the frame as compared with the signal to be encoded, the value of the second distortion which is obtained as the difference in the center-of-gravity is largely evaluated.

FIG. 3(*d*) shows a synthetic speech when a fixed excitation different from that in FIG. 3(*b*) has passed through the synthesis filter. As compared with FIG. 3(*b*), the waveform distortion is slightly larger mainly in the second half of the frame, but the difference in the center-of-gravity position becomes small. In the case of selecting the fixed excitation that generates the signal shown in FIG. 3(*d*), no portion of zero amplitude exists within the frame, and the deterioration of the decoded speech is small. However, in the conventional method, because the selection is conducted by only the waveform distortion, the fixed excitation that generates the signal shown in FIG. 3(*b*) is unavoidably selected. On the contrary, in this embodiment, since the difference in the gravity of center can be reflected in the evaluation value for search as the second distortion, it is possible to select the fixed excitation that generates the signal shown in FIG. 3(*d*) in which the waveform distortion is not so large and the difference in the center of gravity is also smaller.

Note that, in the above-mentioned embodiment, the second distortion is calculated on the basis of the difference in the position of the amplitude center-of-gravity between the signal 12 to be encoded and the synthetic speech outputted from the synthesis filter 14. However, the calculation of the second distortion is not limited to this, and the second distortion may be calculated on the basis of the difference in the position of the power center-of-gravity, or the second distortion may be evaluated with respect to the signal outputted from the perceptual weighting filter 17.

Also, the frame is divided into several sub-frames in the time direction, an average amplitude or an average power within each of the divided sub-frames is calculated with respect to each of the signal 12 to be encoded and the synthetic speech outputted from the synthesis filter 14. Then, the square distance of the calculation result of the signal to be encoded 12 for each of the divided sub-frames and the calculation result of the synthetic speech outputted from the synthesis filter 14 for each of the divided sub-frames may be obtained as the second distortion. Also, it is possible that those several kinds of second distortions are calculated, and a plurality of second distortions are used by the evaluation value for search calculating means 29.

Also, it is possible that in the evaluation value for search calculating portion 29, a structure is changed so as to delete the changeover means 32 and connect the output of the multiplying means 31 to the changeover means 30, and to change β used in the multiplying means 31 in accordance with the second distortion.

Similarly, the first distortion calculating portion 23 is not limited to this structure, but it is possible to apply a structure from which the perceptual weighting filter is deleted, or a structure from which the perceptual weighting is conducted on the outputs of the subtracting means 18 collectively, or to conduct various modifications for the above-mentioned reduction in the amount of calculation.

Similarly, the adaptive excitation contribution degree calculating means 28 may be structured so as to calculate the contribution degree after the perceptual weighting filtering is conducted on two input signals.

In the first embodiment, the synthetic speech obtained by allowing the adaptive excitation to pass through the synthesis filter 10 is subtracted from the input speech 1 to provide the signal to be encoded. However, a structure may be made such that the input speech 1 is used as the signal to be encoded as it is, and instead, the synthetic speech obtained by allowing the fixed excitation to pass through the synthesis filter 14 is made orthogonal to the synthetic speech obtained by allowing the adaptive excitation to pass through the synthesis filter 10.

Also, in the first embodiment, the fixed excitation is searched for each of the frames. However, it is needless to say that it is possible to conduct the search for each of a plurality of sub-frames into which the frame is divided as conventional art.

As described above, according to the first embodiment, the distortion related to the waveform defined between the signal to be encoded and the synthetic vector obtained from the fixed excitation is calculated as the first distortion, the second distortion different from the first distortion which is defined between the signal to be encoded and the synthetic vector obtained from the fixed excitation is calculated, and the fixed excitation that minimizes the evaluation value for search calculated by using the first distortion and the second distortion is selected. Therefore, it is possible to detect by the second distortion the fixed excitation that is high in the possibility of inducing the deterioration of the decoded speech, which cannot be found by only the first distortion. Accordingly, there is an advantage that the high-quality speech encoding which is small in the local occurrence of the abnormal noise in the decoded speech can be realized.

Also, according to the first embodiment, since a result of adding the error powers of the signal resulting from allowing the signal to be encoded which is obtained from the input speech to pass through the perceptual weighting filter and the signal resulting from allowing the synthetic vector obtained from the fixed excitation to pass through the perceptual weighting filter within the frame for each of samples is set as the first distortion, the fixed excitation that is small in the subjective distortion feeling of the decoded speech can be selected. Accordingly, there is an advantage that the high-quality speech encoding can be realized.

Also, according to the first embodiment, since the distortion related to the deviation of the amplitude or the power in the time direction within the frame is set as the second distortion, it is possible to detect by the second distortion the fixed excitation that is high in the possibility of inducing the subjective deterioration of the decoded speech such that the amplitude is locally too small. Accordingly, there is an advantage that the high-quality speech code that is small in the local occurrence of the abnormal noise of the decoded speech can be realized.

Also, according to the first embodiment, since the center-of-gravity position of the amplitude or the power of the signal to be encoded within the frame is obtained, the center-of-gravity position of the amplitude or the power of the synthetic vector within the frame is obtained, and a difference between the obtained two center-of-gravity positions is set as the second distortion, the deviation of the amplitude or the power within the frame can be evaluated regardless of the simple processing, and it is possible to detect by the second distortion the fixed excitation that is high in the possibility of inducing the subjective deterioration of the decoded speech such that the amplitude is locally too small. Accordingly, there is an advantage that the high-quality speech code that is small in the local occurrence of the abnormal noise in the decoded speech can be realized.

Also, according to the first embodiment, since the first distortion is corrected in accordance with the second distortion to calculate the evaluation value for search, the fixed excitation that makes the first distortion which is basically a waveform distortion small and hardly causes any problem with respect to the second distortion which is different from the first distortion can be selected. Accordingly, there is an advantage that the high-quality speech encoding can be realized.

Also, according to the first embodiment, since the evaluation value for search is calculated in accordance with a given parameter such as the adaptive excitation contribution degree calculated from the input speech, only the first distortion is used or a correction is conducted by the second distortion in accordance with a speech state, an encoding characteristic, or the like, thereby being capable of selecting a fixed excitation suitable to the frame which is difficult to deteriorate the quality of the decoded speech. Accordingly, there is an advantage that the high-quality speech encoding can be realized.

Also, according to the first embodiment, since the ratio of the energy of the synthetic vector obtained from the adaptive excitation (the excitation vector other than the fixed excitation) to he energy of the input speech is obtained and used for calculation of the evaluation value for search as the adaptive excitation contribution degree (other excitation contribution degree), the appropriate evaluation value for search can be obtained for each of the frames such that the second distortion is used only by the frame which is large in the contribution degree of the fixed excitation in the decoded speech, thereby being capable of selecting a fixed excitation suitable to the frame which is difficult to deteriorate the quality of the decoded speech. Accordingly, there is an advantage that the high-quality speech encoding can be realized.

Also, according to the first embodiment, a process of setting the first distortion as the evaluation value for search as it is, is included as one of processes for calculating the evaluation value for search s. Thus, in the case where the contribution degree of the fixed excitation in the decoded speech is small, and the decoded speech is not deteriorated even if the amplitude of the fixed excitation deviates, the fixed excitation that minimizes the first distortion which is the waveform distortion can be selected. Accordingly, there is an advantage that the tone quality can be prevented from being deteriorated by unnecessarily using the second distortion.

Second Embodiment

Figure 4:
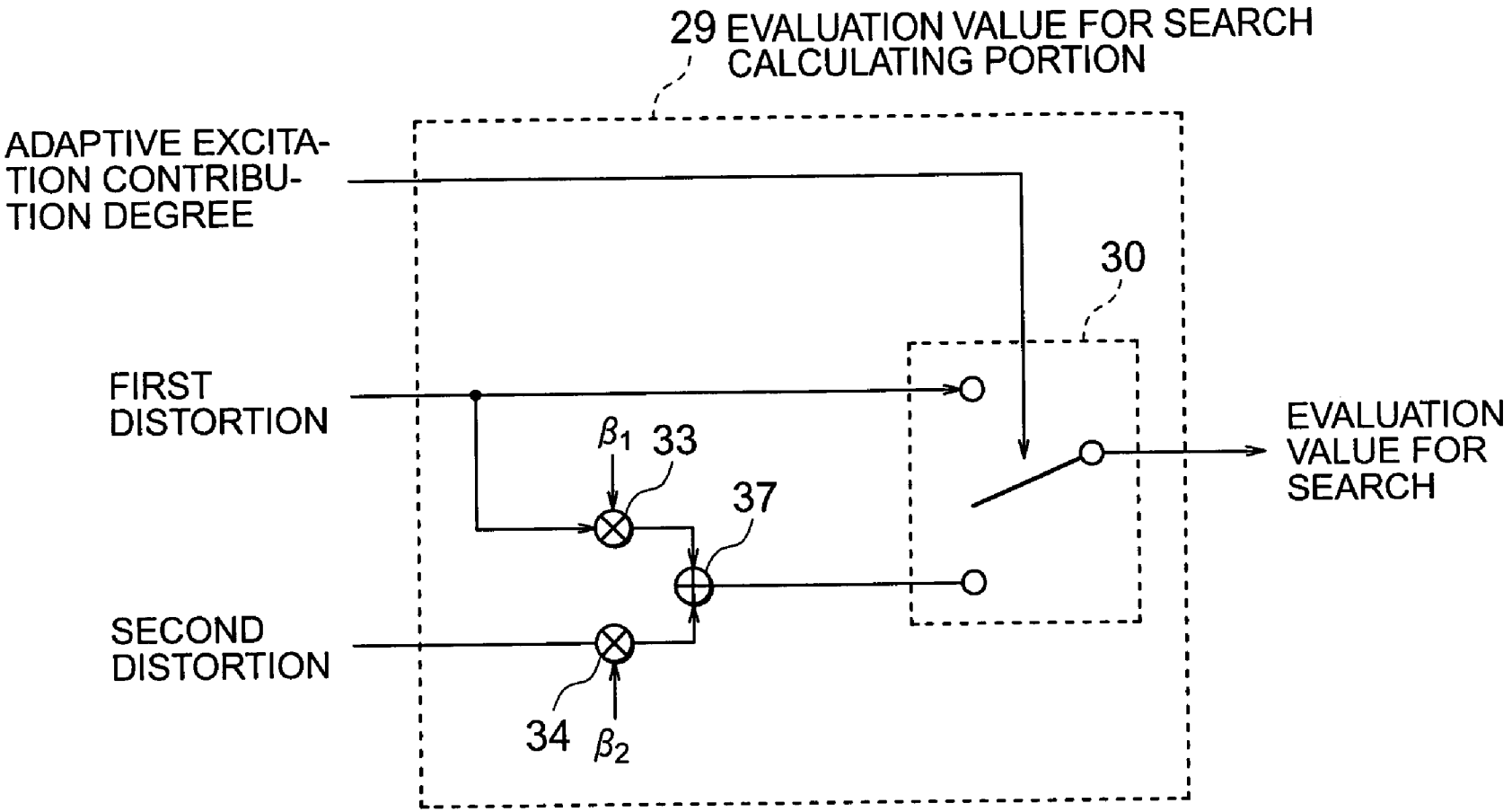
FIG. 4 is a structural diagram showing the structure of a evaluation value for search calculating portion 29 in accordance with a second embodiment of the present invention.

FIG. 4 is a structural diagram showing the structure of the evaluation value for search calculating portion 29 in accordance with a second embodiment.

In FIG. 4, reference numeral 30 denotes a changeover means, reference numerals 31 and 34 denote a multiplying means, and reference numeral 37 is an adder means.

The multiplying means 33 multiplies the first distortion outputted from the first distortion calculating portion 23 by a constant β1 prepared in advance, to output the multiplied result to the adder means 37. It is sufficient to fix the constant β1 to 1.0, so that the multiplying means 33 itself can be omitted.

Also, the multiplying means 34 multiplies the second distortion outputted from the second distortion calculating portion 24 by a constant β2 which is prepared in advance, to output a multiplied result to the adder means 37. The constant β2 is set so as to make the output of the multiplying means 34 smaller in average with respect to the output of the multiplying means 33.

In addition, the adder means 37 adds the output of the multiplying means 33 and the output of the multiplying means 34 together, to output an added result to the changeover means 30.

The changeover means 30 connects the changeover switch to the first distortion outputted from the first distortion calculating portion 23 in the case where the adaptive excitation contribution degree outputted from the adaptive excitation contribution degree calculating means 28 exceeds a given threshold value, and connects the changeover switch to the output result of the adder means 37 in the case where the adaptive excitation contribution degree outputted from the adaptive excitation contribution degree calculating means 28 is equal to or less than the given threshold value. The given threshold value is preferably set to about 0.3 to 0.4. Then, the output of the changeover means 30 is outputted from the evaluation value for search calculating portion 29 as the evaluation value for search.

With the above-mentioned structure, the first distortion is normally outputted as the evaluation value for search, and the second distortion is included in the evaluation value for search and outputted only in the case where the adaptive excitation contribution degree is small. Also, β1 and β2 are set so that the output of the multiplying means 34 becomes small in average as compared with the output of the multiplying means 33 with the result that the correction is conducted by the first distortion that is basically mainly used and the second distortion. Therefore, the evaluation value for search is corrected to a larger value only in the case where the second distortion is relatively large and the adaptive excitation contribution degree is small, and the selection of the corresponding fixed excitation code is suppressed in the downstream searching means 20.

As described above, according to the second embodiment, since the evaluation value for search is calculated in accordance with the weighting sum of the first distortion and the second distortion, the fixed excitation that makes the first distortion which is basically a waveform distortion small and hardly causes any problem with respect to the second distortion which is different from the first distortion can be selected. Accordingly, there is an advantage that the high-quality speech encoding can be realized.

Also, according to the second embodiment, since the ratio of the energy of the synthetic vector obtained from the excitation vector other than the fixed excitation and the energy of the input speech is obtained and set as a given parameter in the evaluation value calculating process, the appropriate evaluation value for search can be obtained for each of the frames such that the second distortion is used only by the frame which is large in the contribution degree of the fixed excitation in the decoded speech, thereby being capable of selecting a fixed excitation suitable to the frame which is difficult to deteriorate the quality of the decoded speech. Accordingly, there is an advantage that the high-quality speech encoding can be realized.

Also, according to the second embodiment, since a process of setting the first distortion as the evaluation value for search as it is, is included as one of processes of calculating the evaluation value for search s. Thus, in the case where the contribution degree of the fixed excitation in the decoded speech is small, and the decoded speech is not deteriorated even if the amplitude of the fixed excitation deviates, the fixed excitation that minimizes the first distortion which is the waveform distortion can be selected. Accordingly, there is an advantage that the tone quality can be prevented from being deteriorated by unnecessarily using the second distortion.

Third Embodiment

Figure 5:
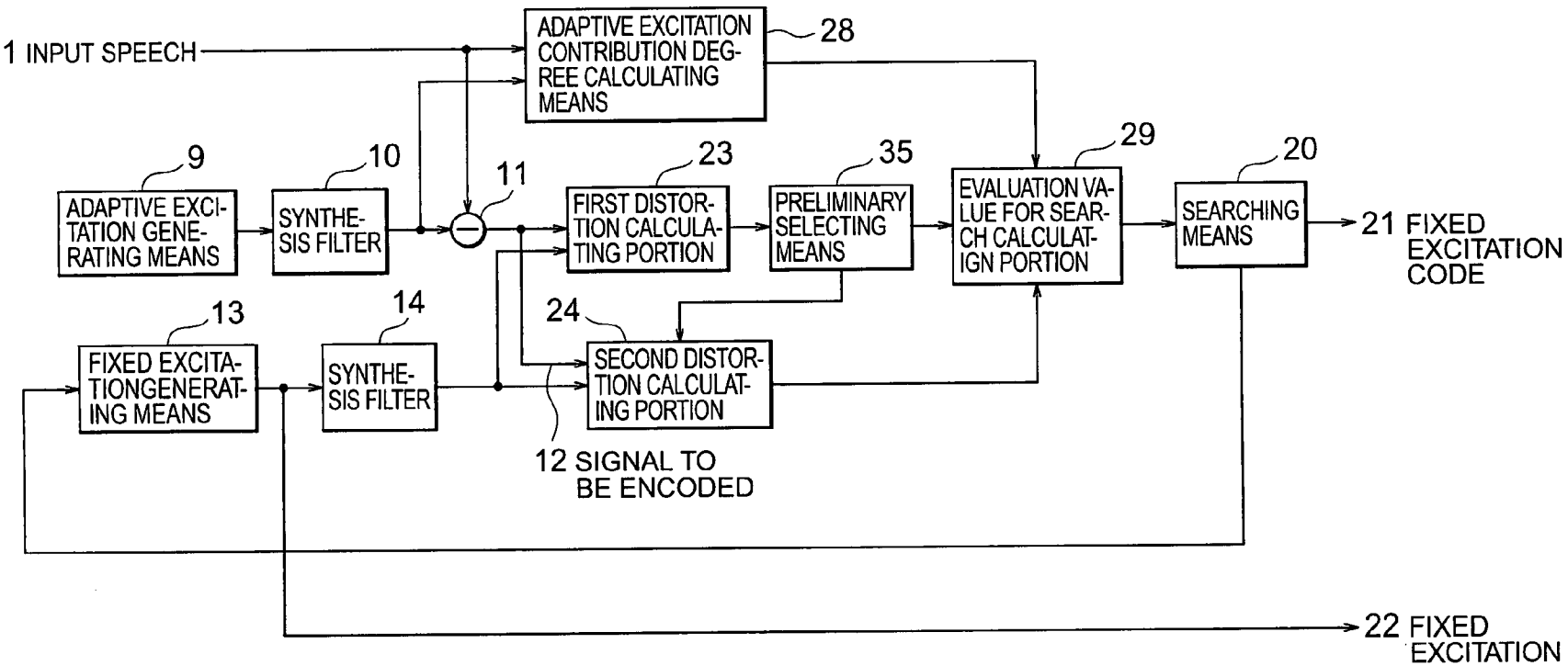
FIG. 5 is a block diagram showing a detailed structure of a fixed excitation encoding portion 5 in the speech encoding device to which the speech encoding method of the present invention is applied in accordance with a third embodiment.

FIG. 5 is a block diagram showing the detailed structure of a fixed excitation encoding portion 5 in accordance with a third embodiment in a speech encoding device to which the speech encoding method of the present invention is applied.

Also in the third embodiment, the overall structure of the speech encoding device is identical with that shown in FIG. 8. However, the input of the input speech 1 is added to the fixed excitation encoding portion 5.

In FIG. 5, the same parts as those in the first embodiment shown in FIG. 1 are designated by the same reference numerals, and their descriptions will be omitted. New reference numeral 35 denotes a preliminary selecting means.

Hereinafter, the operation will be described with reference to the accompanying drawings.

The first distortion calculating portion 23 obtains the total power of difference signals which have been subjected to perceptual weighting filter from a quantized linear prediction coefficient which is outputted from the linear prediction coefficient encoding means 3, a signal 12 to be encoded which is outputted from the subtracting means 11, and a synthetic speech which is outputted from the synthesis filter 14 for each of the fixed excitations, to output the total power to the preliminary selecting means 35 as the first distortion.

The preliminary selecting means 35 compares the first distortion for each of the fixed excitations outputted from the first distortion calculating portion 23 with each other, and preliminarily selects M fixed excitations which are small in the first distortion. M is a number smaller than the number of all the fixed excitations. The fixed excitation Nos. preliminarily selected are outputted to the second distortion calculating portion 24, and the first distortions with respect to the respective fixed excitations preliminarily selected are outputted to the evaluation value for search calculating portion 29.

The second distortion calculating portion 24 obtains a difference in the center-of-gravity position of the amplitude within the frame between the signal 12 to be encoded which is outputted from the subtracting means 11 and the synthetic speech outputted from the synthesis filter 14 for each of the fixed excitations with respect to each of the fixed excitations which are designated by Nos. of the M fixed excitations which are preliminarily selected by and outputted from the preliminary selecting means 35, to output the obtained difference in the center-of-gravity position to the evaluation value for search calculating portion 29 as the second distortion.

The evaluation value for search calculating portion 29 obtains M evaluation value for search s used for final search by using the adaptive excitation contribution degree which is outputted from the adaptive excitation contribution degree calculating means 28, M first distortions which are preliminarily selected by and outputted from the preliminary selecting means 35, and M second distortions which are outputted from the second distortion calculating portion 24, to output the evaluation value for search to the searching means 20.

The searching means 20 searches the fixed excitation code that minimizes the evaluation value for search outputted from the evaluation value for search calculating portion 29, and outputs the fixed excitation code that minimizes the evaluation value for search as the fixed excitation code 21. Also, the fixed excitation generating means 13 outputs the fixed excitation outputted when the fixed excitation code 21 is inputted thereto as the fixed excitation 22.

Note that, in the above-mentioned third embodiment, the second distortion is calculated in accordance with the difference in the position of the amplitude center-of-gravity between the signal 12 to be encoded and the synthetic speech outputted from the synthesis filter 14 as in the first embodiment, but the present invention is not limited to this. The second distortion may be calculated in accordance with the difference in the position of the power center-of-gravity, or may be evaluated with respect to the signal which has been subjected to perceptual weighting filtering. Also, the frame is divided into several sub-frames in the time direction, an average amplitude or an average power within each of the divided sub-frames is calculated with respect to each of the signal 12 to be encoded and the synthetic speech outputted from the synthesis filter 14, and the square distance of the calculation result of the signal to be encoded 12 for each of the divided sub-frames and the calculation result of the synthetic speech outputted from the synthesis filter 14 for each of the divided sub-frames may be obtained as the second distortion. Also, it is possible that those several kinds of second distortions are calculated, and a plurality of second distortions are used by the evaluation value for search calculating means 29.

The first distortion calculating portion 23 can be structured so as to delete the perceptual weighting filter, or conduct the perceptual weighting collectively, or conduct various modifications for the above-mentioned reduction in the amount of calculation.

Also, in the third embodiment, the synthetic speech obtained by allowing the adaptive excitation to pass through the synthesis filter 10 is subtracted from the input speech 1 to provide the signal to be encoded. However, as in the first embodiment, a structure may be made such that the input speech 1 is used as the signal to be encoded as it is, and instead, the synthetic speech obtained by allowing the fixed excitation to pass through the synthesis filter 14 is made orthogonal to the synthetic speech obtained by allowing the adaptive excitation to pass through the synthesis filter 10.

Also, in the third embodiment, the fixed excitation is searched for each of the frames. However, it is needless to say that it is possible to conduct the search for each of a plurality of sub-frames into which the frame is divided as conventional art.

As described above, according to the third embodiment, since two or more fixed excitations which are small in the first distortion are preliminarily selected, and subjects of the calculation of the second distortion, and the calculation and search of the evaluation value for search are limited to the fixed excitations preliminarily selected, there can be obtained, in addition to the advantages obtained by the first embodiment, advantages that the amount of calculation for calculating the second distortion and calculating the evaluation value for search can be suppressed to a small amount of calculation, the fixed excitation which is high in the possibility of inducing the deterioration of the decoded speech can be detected by the second distortion due to an increase in the amount of calculation which is smaller than that in the conventional structure in which search is conducted by only the first distortion, thereby being capable of realizing the high-quality speech encoding which is small in the local occurrence of the abnormal noise in the decoded speech.

Fourth Embodiment

Figure 6:
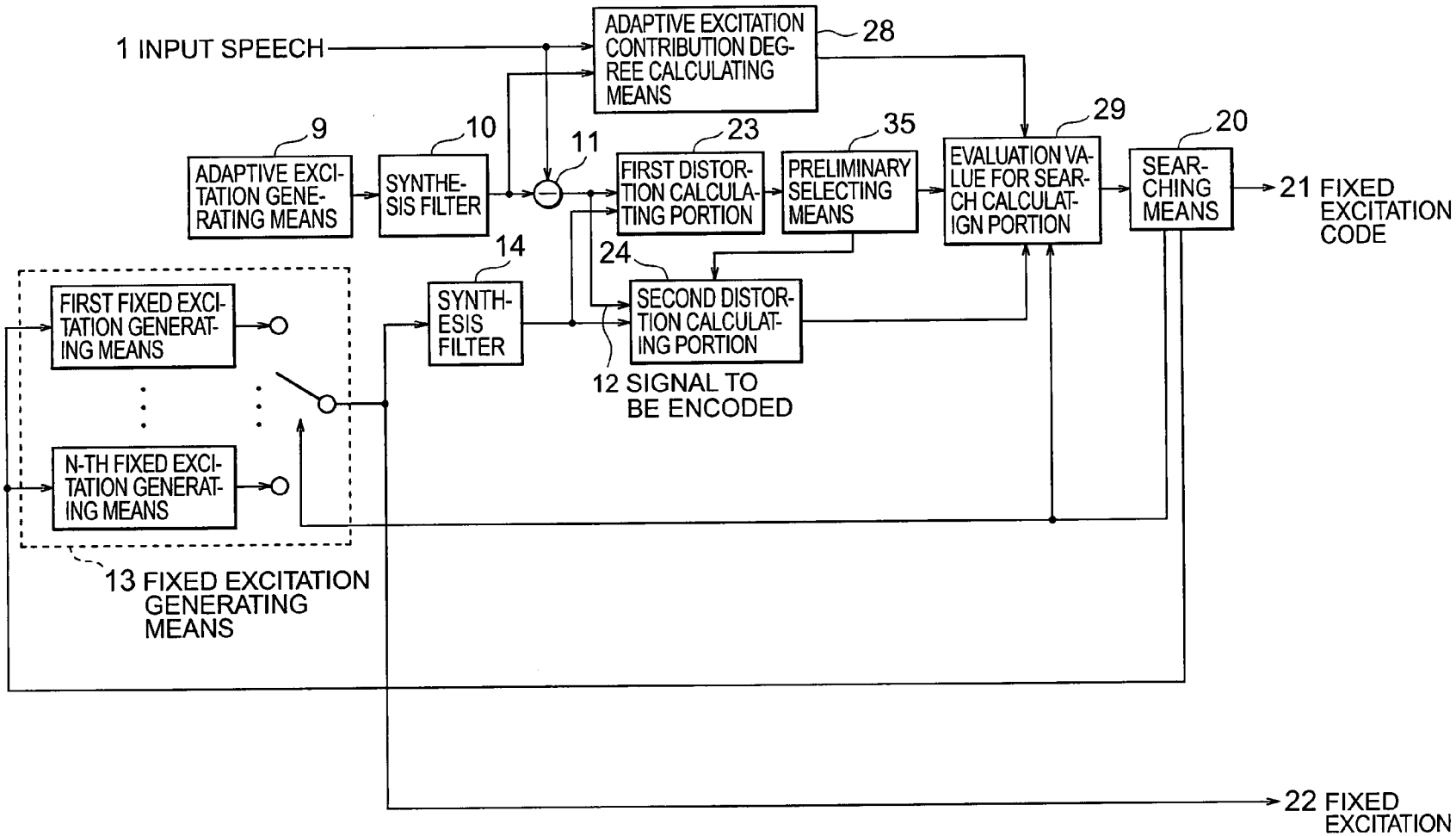
FIG. 6 is a block diagram showing the detailed structure of a fixed excitation encoding portion 5 in the speech encoding device to which the speech encoding method of the present invention is applied in accordance with a fourth embodiment.

FIG. 6 is a block diagram showing the detailed structure of a fixed excitation encoding portion 5 in the speech encoding device to which the speech encoding method of the present invention is applied in accordance with a fourth embodiment.

Similarly, in the fourth embodiment, the overall structure of the speech encoding device is identical with that shown in FIG. 8, but the input of the input speech 1 is added to the fixed excitation encoding portion 5. The same parts as those in the third embodiment are designated by the same reference numerals, and their descriptions will be omitted. In the fourth embodiment, N fixed excitation generating means including a first fixed excitation generating means to an N-th fixed excitation generating means and a changeover means are provided as the fixed excitation generating means 13.

Hereinafter, the operation will be described with reference to the accompanying drawings.

The fixed excitation generating means 13 includes the N fixed excitation generating means including the first fixed excitation generating means to the N-th fixed excitation generating means and the changeover means, and outputs one fixed excitation in accordance with fixed excitation generating means No. and fixed excitation No. when the fixed excitation generating means No. and the fixed excitation No. are inputted from the outside. The changeover means connects the changeover switch to one fixed excitation generating means in accordance with the inputted fixed excitation generating means No., and the connected first to N-th fixed excitation generating means output the fixed excitations which are designated by the inputted fixed excitation Nos.

Note that, the plurality of fixed excitation generating means are different from each other, and various fixed excitation generating means are preferably provided in order to stably encode the speech signal having various modes, such as fixed excitation generating means in which an energy is concentrated in the first half within the frame, fixed excitation generating means in which the energy is concentrated in the second half within the frame, fixed excitation generating means in which the energy is relatively dispersedly distributed within the frame, fixed excitation generating means which are structured by a small number of pulses, fixed excitation generating means which are structured by a large number of pulses.

The searching means 20 sequentially generates the respective fixed excitation codes indicated by binary values, decomposes the fixed excitation codes into the fixed excitation generating means Nos. and the fixed excitation Nos., and outputs the fixed excitation generating means Nos. to the changeover means within the fixed excitation generating means 13 and the evaluation value for search calculating portion 29. Also, the searching means 20 outputs the fixed excitation Nos. to the first to N-th fixed excitation generating means with the fixed excitation generating means 13.

The fixed excitation generating means 13 outputs one fixed excitation to the synthesis filter 14 in accordance with the fixed excitation generating means No. and the fixed excitation No. outputted from the searching means 20.

The synthesis filter 14 sets the quantized linear prediction coefficient that are outputted from the linear prediction coefficient encoding means 3 as the filter coefficient, and conducts the synthesis filtering on the fixed excitation outputted from the fixed excitation generating means 13, to output the obtained synthetic speech to the first distortion calculating portion 23 and the second distortion calculating portion 24.

The first distortion calculating portion 23 obtains the total power of difference signals which have been subjected to perceptual weighting filter from a quantized linear prediction coefficient which is outputted from the linear prediction coefficient encoding means 3, a signal 12 to be encoded which is outputted from the subtracting means 11, and a synthetic speech which is outputted from the synthesis filter 14 for each of the fixed excitations, to output the total power to the preliminary selecting means 35 as the first distortion.

The preliminary selecting means 35 compares the first distortion for each of the fixed excitations which is outputted from the first distortion calculating portion 23 with each other, and preliminarily selects M fixed excitations which are small in the first distortion. Note that, M is a number smaller than the number of all the fixed excitations. The fixed excitation Nos. preliminarily selected are outputted to the second distortion calculating portion 24, and outputs the first distortions with respect to the respective fixed excitations preliminarily selected to the evaluation value for search calculating portion 29. Note that, the preliminary selecting means 35 may be structured so as to input the fixed excitation generating means No. from the searching means 20 and preliminarily select L fixed excitations for each of the same fixed excitation generating means Nos. If L is set to 1, the number of preliminary selections M coincides with N.

The second distortion calculating portion 24 obtains a difference in the center-of-gravity position of the amplitude within the frame between the signal 12 to be encoded which is outputted from the subtracting means 11 and the synthetic speech outputted from the synthesis filter 14 for each of the fixed excitations with respect to each of the fixed excitations which are designated by Nos. of the M fixed excitations which are preliminarily selected by and outputted from the preliminary selecting means 35, to output the obtained difference in the center-of-gravity position to the evaluation value for search calculating portion 29 as the second distortion.

The evaluation value for search calculating portion 29 obtains M evaluation value for search s used for final search by using the adaptive excitation contribution degree which is outputted from the adaptive excitation contribution degree calculating means 28, the fixed excitation generating means No. which is outputted from the searching means 20, M first distortions which are preliminarily selected by and outputted from the preliminary selecting means 35, and M second distortions which are outputted from the second distortion calculating portion 24, to output the evaluation value for search to the searching means 20.

The searching means 20 searches the fixed excitation code that minimizes the evaluation value for search outputted from the evaluation value for search calculating portion 29, and outputs the fixed excitation code that minimizes the evaluation value for search as the fixed excitation code 21. Also, the fixed excitation generating means 13 outputs the fixed excitation outputted when the fixed excitation code 21 is inputted thereto as the fixed excitation 22.

Figure 7:
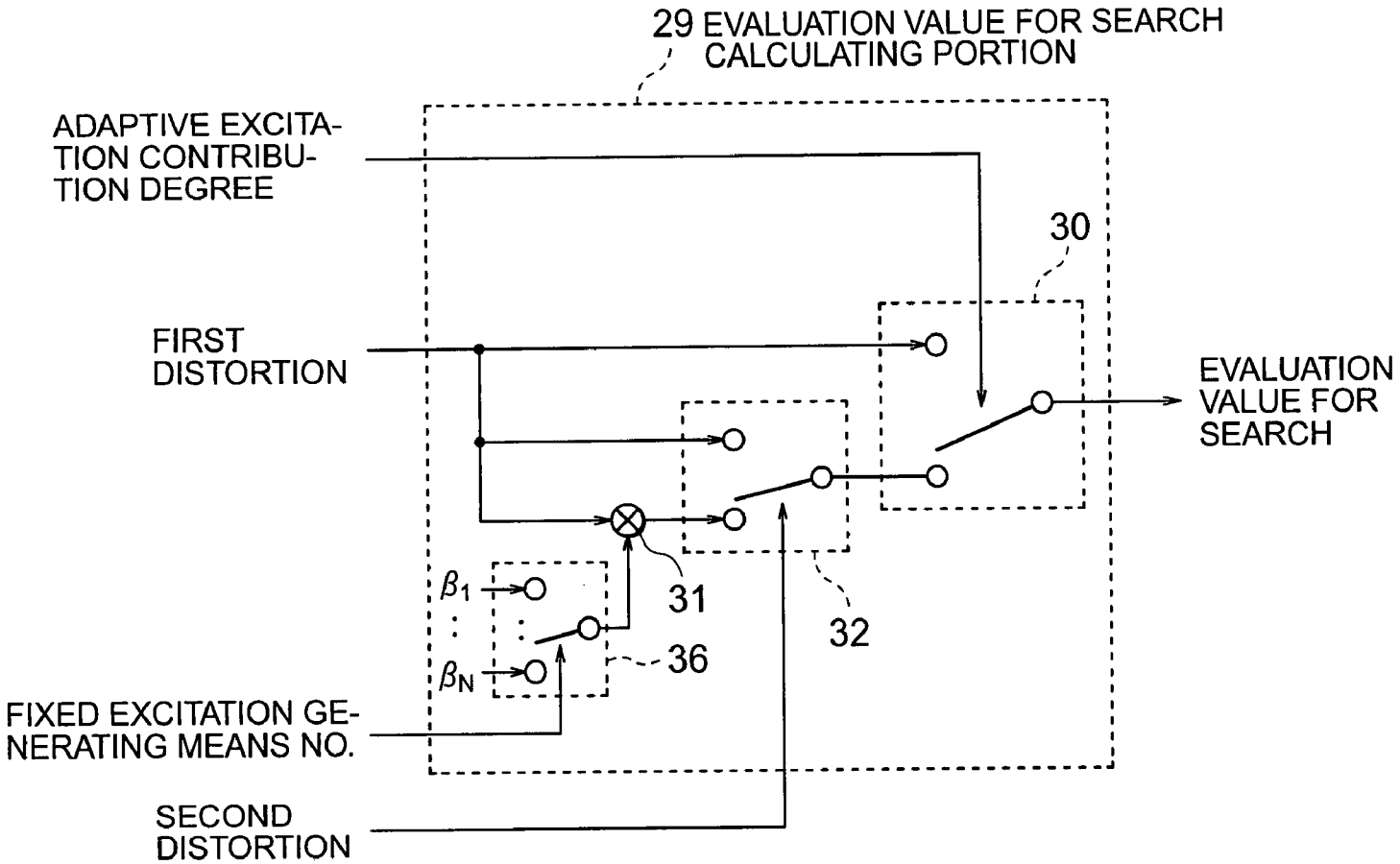
FIG. 7 is a structural diagram showing the structure of a evaluation value for search calculating portion 29 in accordance with the fourth embodiment of the present invention.

FIG. 7 is a structural diagram showing the structure of the evaluation value for search calculating portion 29.

In FIG. 7, reference numerals 30, 32, and 36 denote changeover means, and reference numeral 31 is a multiplying means.

Within the evaluation value for search calculating portion 29, N constants β1 to βN are set in correspondence with the fixed excitation generating means Nos. in advance.

The changeover means 36 changes over the changeover switch in accordance with the fixed excitation generating means No. which is outputted from the searching means 20, and selects and outputs one constant so as to output β1 when the fixed excitation generating means No. is 1, and output βN when the fixed excitation generating means No. is N.

The multiplying means 31 multiplies the first distortion, outputted from the first distortion calculating portion 23 by the constant outputted from the changeover means 36, to output the multiplied result.

The changeover means 32 connects a changeover switch to the multiplied result outputted from the multiplying means 31 in the case where the second distortion outputted from the second distortion calculating portion 24 exceeds a given threshold value, and connects the changeover switch to the first distortion outputted from the first distortion calculating portion 23 in the case where the second distortion outputted from the second distortion calculating portion 24 is equal to or less than the given threshold value. The given threshold value is appropriately set to about 1/10 of the frame length. As a result, the changeover means 32 outputs the result obtained by multiplying the first distortion by the constant in corresponding with the fixed excitation generating means No. when the second distortion is larger, and the first distortion as it is when the second distortion is smaller.

The changeover means 30 connects the changeover switch to the first distortion outputted from the first distortion calculating portion 23 in the case where the adaptive excitation contribution degree outputted from the adaptive excitation contribution degree calculating means 28 exceeds a given threshold value, and connects the changeover switch to the output result of the changeover means 32 in the case where the adaptive excitation contribution degree outputted from the adaptive excitation contribution degree calculating means 28 is equal to or less than the given threshold value. The given threshold value is preferably set to about 0.3 to 0.4. Then, the output of the changeover means 30 is outputted from the evaluation value for search calculating portion 29 as the evaluation value for search.

With the above-mentioned structure, the first distortion is normally outputted as the evaluation value for search, and the value obtained by multiplying the first distortion by the constant in corresponding with the fixed excitation generating means No. is outputted as the evaluation value for search only when the second distortion is larger and the adaptive excitation contribution degree is smaller. That is, only in the case where the second distortion is larger and the adaptive excitation contribution degree is smaller, the evaluation value for search is corrected to a larger value, while the amount of correction is controlled in accordance with the fixed excitation generating means Nos., and the selection of the corresponding fixed excitation code is suppressed in the downstream searching means 20.

Note that, also in the above-mentioned fourth embodiment, a structure can be made such that the changeover switch 32 is changed to the multiplying means 33 and the adder means 37 shown in FIG. 4 as in the second embodiment.

Also, as in the first embodiment, the second distortion is calculated on the basis of the difference in the position of the amplitude center-of-gravity between the signal 12 to be encoded and the synthetic speech outputted from the synthesis filter 14. However, the calculation of the second distortion is not limited to this, and the second distortion may be calculated on the basis of the difference in the position of the power center-of-gravity, or the second distortion may be evaluated with respect to the signal which has been subjected to the perceptual weighting filtering. The frame is divided into several sub-frames in the time direction, an average amplitude or an average power within each of the divided sub-frames is calculated with respect to each of the signal 12 to be encoded and the synthetic speech outputted from the synthesis filter 14. Then, the square distance of the calculation result of the signal to be encoded 12 for each of the divided sub-frames and the calculation result of the synthetic speech outputted from the synthesis filter 14 for each of the divided sub-frames may be obtained as the second distortion. Also, it is possible that those several kinds of second distortions are calculated, and a plurality of second distortions are used by the evaluation value for search calculating means 29.

The first distortion calculating portion 23 can be structured so as to delete the perceptual weighting filter, conduct the perceptual weighting collectively, or conduct various modifications for the above-mentioned reduction in the amount of calculation.

Also, in the fourth embodiment, the synthetic speech obtained by allowing the adaptive excitation to pass through the synthesis filter 10 is subtracted from the input speech 1 to provide the signal to be encoded. However, as in the first embodiment, a structure may be made such that the input speech 1 is used as the signal to be encoded as it is, and instead, the synthetic speech obtained by allowing the fixed excitation to pass through the synthesis filter 14 is made orthogonal to the synthetic speech obtained by allowing the adaptive excitation to pass through the synthesis filter 10.

Also, in the fourth embodiment, the fixed excitation is searched for each of the frames. However, it is needless to say that it is possible to conduct the search for each of a plurality of sub-frames into which the frame is divided as conventional art.

As described above, according to the fourth embodiment, since there are provided a plurality of fixed excitation generating means (steps) for generating fixed excitations different from each other, at least one fixed excitation which is small in the first distortion which is calculated by the first distortion calculating means (step) is preliminarily selected, and subjects of the calculation of the second distortion, the calculation and search of the evaluation value for search are limited to the fixed excitation preliminarily selected, there can be provided, in addition to the advantages obtained by the third embodiment, the advantages that the candidacy of one or more fixed excitations can remain for each of the fixed excitation generating means (steps) which are variously different in the excitation position definition, the number of pulses, or the like, the fixed excitation which is high in the possibility of inducing the deterioration of the decoded speech is detected from the candidacy of the fixed excitations which are variously different in the excitation position definition, the number of pulses, or the like to suppress the selection, thereby being capable of realizing the high-quality speech encoding which is small in the local occurrence of the abnormal noise in the decoded speech regardless of small increase in the calculation amount.

Note that, in the third embodiment, since there is no guarantee that the fixed excitations which are variously different in the excitation position definition, the number of pulses, or the like are preliminarily selected, for example, in the case where only the fixed excitation in which the energy is concentrated in the first half within the frame is preliminarily selected, there is the possibility that the fixed excitations which are small in the difference in the center-of-gravity (second distortion) are not included in the fixed excitations preliminarily selected. In this case, the local deterioration of the decoded speech cannot be eliminated.

According to the fourth embodiment, since the constant used for calculation of the evaluation value for search changes among $\beta 1$ to $\beta N$ (a process of calculating the evaluation value for search changes) in accordance with from which fixed excitation generating means (step) the fixed excitation is outputted, it is possible that the weight of the second distortion in the evaluation value for search is selectively increased and the selection of the fixed excitation outputted from the fixed excitation generating means (step) is suppressed in the fixed excitation generating means (step) which is liable to induce the deterioration of the decoded speech when the second distortion becomes large, thereby being capable of realizing the high-quality speech encoding which is small in the local occurrence of the abnormal noise in the decoded speech.

Fifth Embodiment

In all of the above-mentioned first to fourth embodiments, the present invention is applied to the search of the fixed excitation in the excitation structured by adding the adaptive excitation and the fixed excitation. However, the structure of the excitation is not limited to this. For example, the present invention can be applied to a excitation structured by only the fixed excitation for expressing the rising portion of the speech.

In this case, the adaptive excitation encoding means 4, the adaptive excitation generating means 9, and the synthesis filter 10 are not required, and the output of the adaptive excitation contribution degree calculating means 28 is always set to 0.

With the above-mentioned structure, even in the case where the excitation is structured by only the fixed excitation, it is possible that the fixed excitation that is high in the possibility of inducing the deterioration of the decoded speech, which is not found by only the first distortion, is detected by the second distortion, thereby being capable of realizing the high-quality speech encoding which is small in the local occurrence of the abnormal noise in the decoded speech.

Sixth Embodiment

In the above-mentioned first to fourth embodiments, the present invention is applied to the search of the fixed excitation, but the present invention can be applied to the search of the adaptive excitation.

In this case, the fixed excitation generating means 13 in the fifth embodiment is changed to the adaptive excitation generating means 9.

With the above-mentioned structure, it is possible that the adaptive excitation that is high in the possibility of inducing the deterioration of the decoded speech, which is not found by only the first distortion, is detected by the second distortion, thereby being capable of realizing the high-quality speech encoding which is small in the local occurrence of the abnormal noise in the decoded speech.

Seventh Embodiment

In the above-mentioned first to fourth embodiments, only one fixed excitation is selected, but it is needless to say that it is possible that two sub-fixed excitation generating means are provided, and one fixed excitation is structured by adding two sub-fixed excitations which are outputted from those sub-fixed excitation generating means, respectively.

In this case, other structures may be identical with those in the first to fourth embodiments, but it is possible that in searching the sub-fixed excitation which is outputted from one sub-fixed excitation generating means, the other sub-fixed excitation which has been already determined and the contribution degree of the adaptive excitation are obtained and used for the calculation of the evaluation value for search.

With the above-mentioned structure, it is possible that the sub-fixed excitation that is high in the possibility of inducing the deterioration of the decoded speech, which is not found by only the first distortion, is detected by the second distortion, thereby being capable of realizing the high-quality speech encoding which is small in the local occurrence of the abnormal noise in the decoded speech.

INDUSTRICAL APPLICABILITY

As has been described above, according to the present invention, since the distortion related to the waveform defined between the signal to be encoded and the synthetic vector obtained from the fixed excitation is calculated as the first distortion, the second distortion different from the first distortion which is defined between the signal to be encoded and the synthetic vector obtained from the fixed excitation is calculated, and the fixed excitation that minimizes the evaluation value for search calculated by using the first distortion and the second distortion is selected. Consequently, it is possible to detect the fixed excitation that is high in the possibility of inducing the deterioration of the decoded speech, which cannot be found by only the first distortion, by the second distortion, thereby being capable of realizing the high-quality speech encoding which is small in the local occurrence of the abnormal noise in the decoded speech.

What is claimed is:

1. A speech encoding method of encoding an input speech for each of given length sections which are called frames, comprising:

a fixed excitation generating step of generating a plurality of fixed excitations;

a first distortion calculating step of calculating a distortion related to a waveform defined between a signal to be encoded which is obtained from the input speech and a synthetic vector which is obtained from the fixed excitation as a first distortion for each of the fixed excitations;

a second distortion calculating step of calculating a second distortion different from the first distortion which is defined between the signal to be encoded and the synthetic vector which is obtained from the fixed excitation for each of the fixed excitations;

an evaluation value calculating step of calculating a given evaluation value for a search by using the first distortion and the second distortion for each of the fixed excitations; and a searching step of selecting the fixed excitation that minimizes the evaluation value for the search and outputting a code which is associated with the selected fixed excitation in advance.

2. A speech encoding method as claimed in claim 1, further comprising a preliminary selecting step of selecting two or more fixed excitations which are small in the first distortion calculated by the first distortion calculating step, wherein subjects of the second distortion calculating step, the evaluation calculating step, and the searching step are limited to the fixed excitation selected by the preliminary selecting step.

3. A speech encoding method as claimed in claim 1, further comprising:

a plurality of fixed excitation generating steps of generating the fixed excitations different from each other; and a preliminary selecting step of selecting one or more fixed excitations which is small in the first distortion calculated by the first distortion calculating step for each of the fixed excitation generating steps, wherein subjects of the second distortion calculating step, the evaluation calculating step, and the searching step are limited to the fixed excitation selected by the preliminary selecting step.

4. A speech encoding method as claimed in claim 3, wherein the evaluation value calculating step changes a process of calculating the evaluation value for the search in accordance with from which fixed excitation generating step the fixed excitation is outputted.

5. A speech encoding method as claimed in claim 1, wherein the first distortion calculating step sets as the first distortion a result of adding an error power of a signal resulting from allowing the signal to be encoded which is obtained from the input speech to pass through the perceptual weighting filtering and a signal resulting from allowing the synthetic vector obtained from the fixed excitation to pass through the perceptual weighting filter for each of samples within the frame.

6. A speech encoding method as claimed in claim 1, wherein the second distortion calculating step sets the distortion related to the deviation of an amplitude or a power in a time direction within the frame as a second distortion.

7. A speech encoding method as claimed in claim 6, wherein the second distortion calculating step obtains a center-of-gravity position of the amplitude or the power of the signal to be encoded within the frame, obtains the center-of-gravity position of the amplitude or the power of the synthetic vector within the frame, and sets a difference of the obtained two center-of-gravity positions as the second distortion.

8. A speech encoding method as claimed in claim 1, wherein the evaluation value calculating step calculates the evaluation value for search by correcting the first distortion in accordance with the second distortion.

9. A speech encoding method as claimed in claim 1, wherein the evaluation value calculating step calculates the evaluation value for the search by a weighting sum of the first distortion and the second distortion.

10. A speech encoding method as claimed in claim 1, wherein the evaluation value calculating step changes a process of calculating the evaluation value for the search in accordance with a given parameter calculated from the input speech.

11. A speech encoding method as claimed in claim 10, further comprising a contribution degree calculating step of setting as another excitation contribution degree a ratio of an energy of the synthetic vector obtained from the excitation vector other than the fixed excitation and an energy of the input speech, wherein the calculated another excitation contribution degree is set as the given parameter in the evaluation value calculating step.

12. A speech encoding method as claimed in claim 1, wherein the evaluation value calculating step includes a process of setting the first distortion as the evaluation value for the search as it is as one of processes of calculating the evaluation value for the search.

13. A speech encoding device for encoding an input speech for each of given length sections which are called frames, comprising:

fixed excitation generating device that generates a plurality of fixed excitations;

a first distortion calculating device that calculates a distortion related to a waveform defined between a signal to be encoded which is obtained from the input speech and a synthetic vector which is obtained from the fixed excitation as a first distortion for each of the fixed excitations;

a second distortion calculating device that calculates a second distortion different from the first distortion which is defined between the signal to be encoded and the synthetic vector which is obtained from the fixed excitation for each of the fixed excitations;

an evaluation value calculating device that calculates a given evaluation value for search by using the first distortion and the second distortion for each of the fixed excitations; and a searching device that selects the fixed excitation that minimizes the evaluation value for the search and outputting a code which is associated with the selected fixed excitation in advance.

14. A speech encoding device as claimed in claim 13, wherein the first distortion calculating device sets as the first distortion a result of adding an error power of a signal resulting from allowing the signal to be encoded which is obtained from the input speech to pass through the perceptual weighting filtering and a signal resulting from allowing the synthetic vector obtained from the fixed excitation to pass through the perceptual weighting filter for each of samples within the frame.

15. A speech encoding device as claimed in claim 13, wherein the second distortion calculating device sets the distortion related to the deviation of an amplitude or a power in a time direction within the frame as a second distortion.

16. A speech encoding device as claimed in claim 13, wherein the evaluation value calculating device calculates the evaluation value for the search by correcting the first distortion in accordance with the second distortion.

17. A speech encoding device as claimed in claim 13, wherein the evaluation value calculating device changes a process of calculating the evaluation for the search in accordance with a given parameter calculated from the input speech.

* * * * *